US012458850B2

(12) United States Patent
Mizutani

(10) Patent No.: US 12,458,850 B2
(45) Date of Patent: Nov. 4, 2025

(54) GOLF CLUB HEAD

(71) Applicant: SUMITOMO RUBBER INDUSTRIES, LTD., Kobe (JP)

(72) Inventor: Naruhiro Mizutani, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 247 days.

(21) Appl. No.: 17/940,220

(22) Filed: Sep. 8, 2022

(65) Prior Publication Data

US 2023/0095522 A1 Mar. 30, 2023

(30) Foreign Application Priority Data

Sep. 22, 2021 (JP) ..... 2021-154899

(51) Int. Cl.
*A63B 53/04* (2015.01)

(52) U.S. Cl.
CPC ..... *A63B 53/0437* (2020.08); *A63B 53/0466* (2013.01)

(58) Field of Classification Search
CPC ..... A63B 53/0433; A63B 53/0437; A63B 53/0466; A63B 53/045
USPC ..... 473/345–346
See application file for complete search history.

(56) References Cited

U.S. PATENT DOCUMENTS 5,193,810 A * 3/1993 Antonious ..... A63B 60/52 473/327
6,146,287 A * 11/2000 Rugge ..... A63B 60/00 473/334
6,332,848 B1 * 12/2001 Long ..... A63B 53/0466 473/328
8,226,501 B2 * 7/2012 Stites ..... A63B 53/047 473/328
8,414,422 B2 * 4/2013 Peralta ..... A63B 53/04 473/335
8,556,742 B2 * 10/2013 John ..... A63B 53/047 473/238
8,608,587 B2 * 12/2013 Henrikson ..... A63B 60/52 473/409

(Continued)

FOREIGN PATENT DOCUMENTS

JP 2020-124360 A 8/2020

OTHER PUBLICATIONS

USGA—2019 Equipment Rules (4)(b)(i)—Dimensional specifications for woods, available at www.usga.org; retrieved on the internet on Sep. 27, 2024. (Year: 2019).*

*Primary Examiner* — Sebastiano Passaniti
(74) *Attorney, Agent, or Firm* — Birch, Stewart, Kolasch & Birch, LLP

(57) ABSTRACT

A hollow head includes a face portion, a crown portion, a sole portion, and a hosel portion. The crown portion forms a crown outer surface and a crown inner surface. The crown portion includes a crown atypically-shaped portion and a crown rib that is disposed on the crown inner surface. The crown atypically-shaped portion is a crown projection that forms a projection on the crown outer surface while forming a recess on the crown inner surface, or a crown recess that forms a recess on the crown outer surface while forming a projection on the crown inner surface. The crown rib is positioned on a crown center side relative to a center of the crown atypically-shaped portion.

20 Claims, 31 Drawing Sheets

(56) References Cited

U.S. PATENT DOCUMENTS

2002/0065147 A1* 5/2002 Sano ..... A63B 53/04 473/346
2004/0018891 A1* 1/2004 Antonious ..... A63B 53/0466 473/349
2005/0221913 A1* 10/2005 Kusumoto ..... A63B 53/0466 473/345
2005/0250596 A1* 11/2005 Chuang ..... A63B 53/047 473/345
2010/0062875 A1* 3/2010 Hoffman ..... A63B 53/0466 473/346
2010/0261549 A1* 10/2010 Wada ..... A63B 53/0466 473/346
2011/0070968 A1* 3/2011 Stites ..... A63B 57/00 473/319
2011/0177881 A1* 7/2011 Hayase ..... A63B 53/0466 473/346
2011/0183776 A1* 7/2011 Breier ..... A63B 53/0466 473/345
2011/0244979 A1* 10/2011 Snyder ..... A63B 60/00 473/327
2012/0135821 A1* 5/2012 Boyd ..... A63B 60/54 473/342
2012/0302369 A1* 11/2012 Ban ..... A63B 53/04 473/346
2013/0344987 A1* 12/2013 Takechi ..... A63B 53/04 29/527.4
2014/0113744 A1* 4/2014 Kuan ..... A63B 53/0466 473/345
2015/0072803 A1* 3/2015 Golden ..... A63B 60/02 473/345
2015/0238827 A1* 8/2015 Nakamura ..... A63B 53/0466 473/345
2016/0101329 A1* 4/2016 Cole ..... A63B 53/0466 473/346
2016/0213985 A1* 7/2016 Jertson ..... A63B 53/0466
2018/0296885 A1 10/2018 Nakamura
2018/0296888 A1* 10/2018 Onuki ..... A63B 60/54

* cited by examiner

A-A

C-C

GOLF CLUB HEAD

CROSS REFERENCE TO RELATED APPLICATION

The present application claims priority to Japanese Patent Application No. 2021-154899 filed on Sep. 22, 2021. The entire contents of this Japanese Patent Application are hereby incorporated by reference.

BACKGROUND

Technical Field

The present disclosure relates to a golf club head.

Description of the Related Art

There has been known a golf club head including a crown. The crown is usually formed of a convex curved surface that is smooth and continuous as a whole. On the other hand, JP2020-124360A discloses a golf club head having a step on its crown. This step contributes to lowering the position of a back part of the head and lowering the position of the center of gravity of the head.

SUMMARY

The shape of a crown can influence the characteristics of a head. The inventor of the present disclosure considered providing a projection or a recess on a crown that is otherwise usually smooth and continuous. This projection or recess can also influence the aerodynamic characteristic of a head, for example. This projection or recess also can influence the position of the center of gravity of a head, for example. The presence of a projection or a recess on a crown can increase the degree of freedom in design of a head.

The inventor, however, has found that such a projection or recess also affects the sound of a golf club head produced when striking a golf ball (hereinafter, this sound is also simply referred to as sound at impact). The inventor has also found that a projection or a recess provided on a crown lowers the pitch of sound at impact and reduces the degree of freedom in design of sound at impact.

One of the objects of the present disclosure is to provide a golf club head that has a projection or a recess on its crown and is capable of improving and adjusting sound at impact In one aspect, a golf club head of the present disclosure is hollow. The golf club head includes a face portion that forms a striking face, a crown portion that forms a crown outer surface and a crown inner surface, a sole portion that forms a sole outer surface and a sole inner surface, and a hosel portion. The crown portion includes a crown atypically-shaped portion and a crown rib that is disposed on the crown inner surface. The crown atypically-shaped portion is a crown projection that forms a projection on the crown outer surface while forming a recess on the crown inner surface, or a crown recess that forms a recess on the crown outer surface while forming a projection on the crown inner surface. The crown rib is positioned on a crown center side relative to a center of the crown atypically-shaped portion.

BRIEF DESCRIPTION OF THE DRAWINGS

FIG. 2 shows the head which is in a reference state;

DESCRIPTION OF THE PREFERRED EMBODIMENTS

Hereinafter, the present disclosure will be described in detail according to the preferred embodiments with appropriate references to the accompanying drawings.

In the present disclosure, a reference state, a reference perpendicular plane, a toe-heel direction, a face-back direction, an up-down direction, and a face center are defined as follows.

Figure 31:
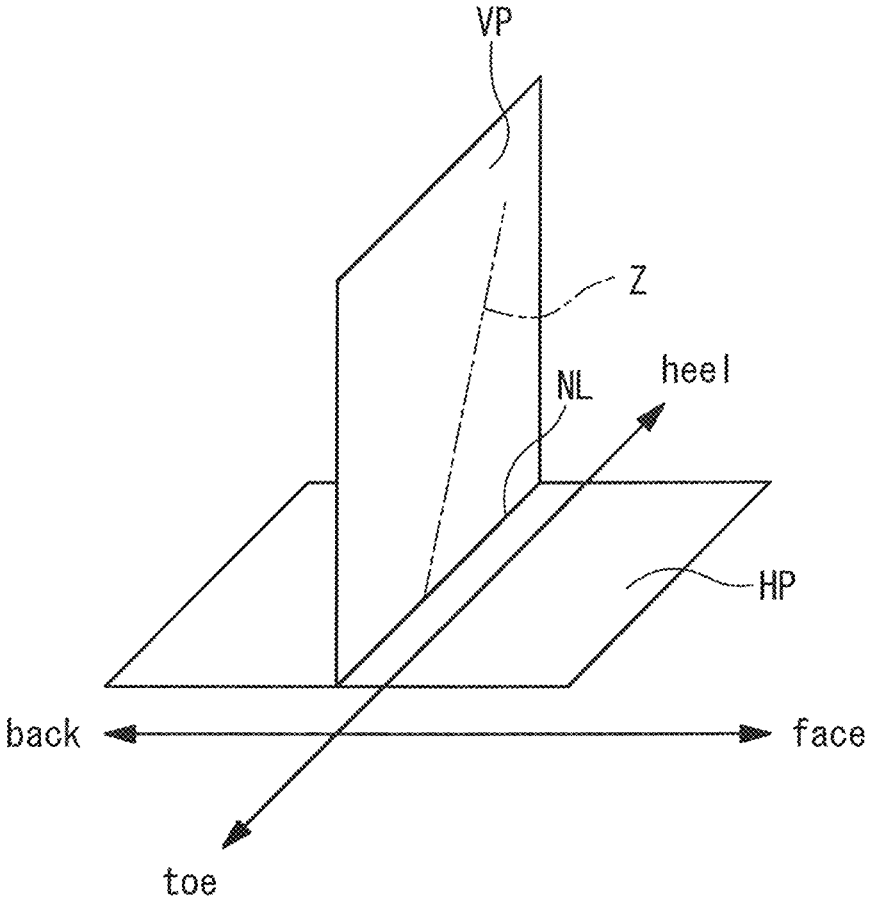
FIG. 31 is a conceptual diagram for illustrating a reference state.

The reference state is a state where a head is placed at a predetermined lie angle on a ground plane HP. As shown in FIG. 31, in the reference state, a shaft axis line Z lies on (is contained in) a plane VP that is perpendicular to the ground plane HP. The shaft axis line Z is the center line of a shaft. The shaft axis line Z usually coincides with the center line of a hosel hole (shaft hole). The plane VP is defined as the reference perpendicular plane. The predetermined lie angle is shown in a product catalog, for example.

In the reference state, a face angle is 0°. That is, in a planar view of a head as viewed from above, a line normal to its striking face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 31).

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

Figure 1:
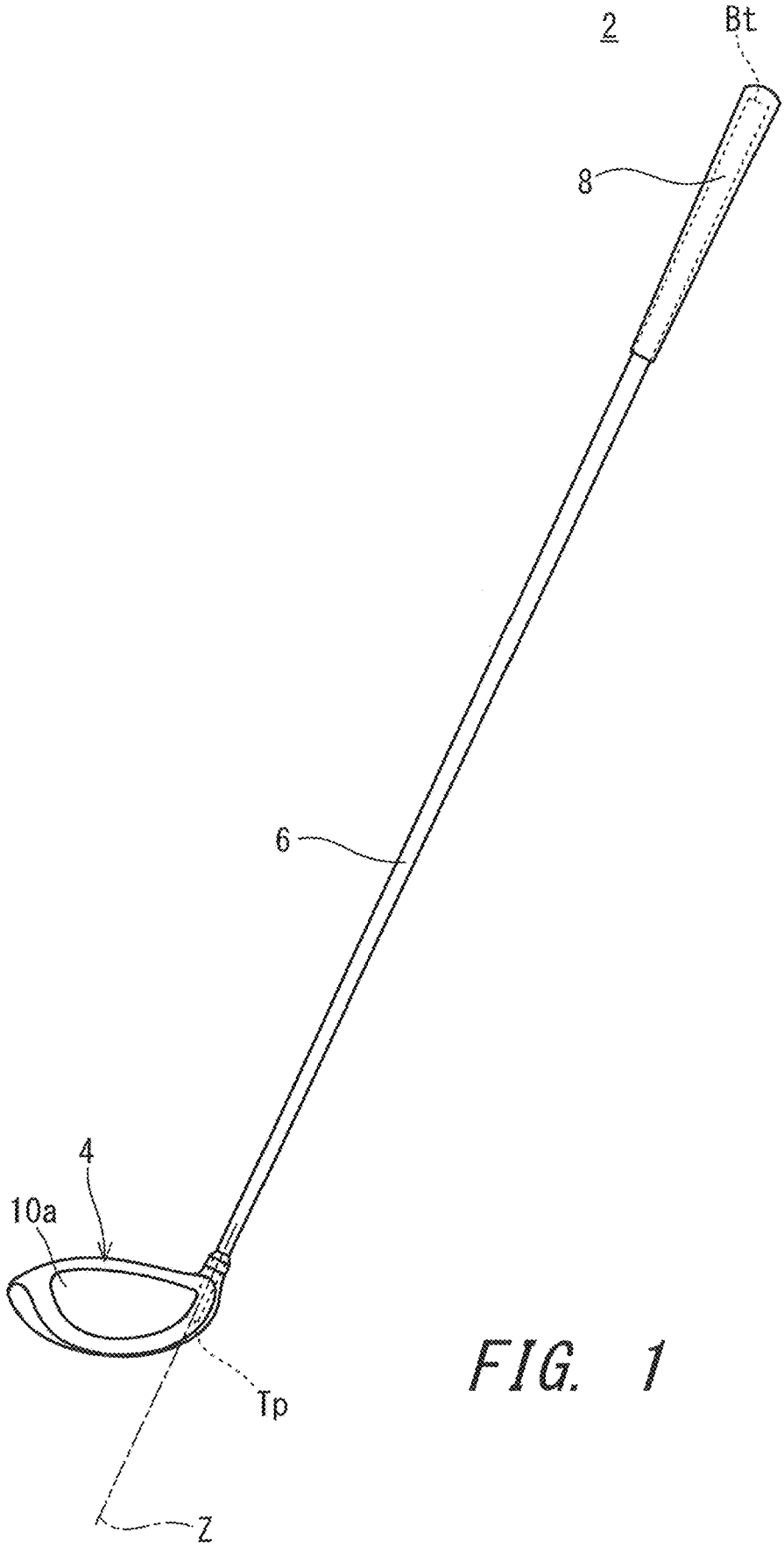
FIG. 1 shows a golf club in which a head according to a first embodiment is attached.
Figure 2:
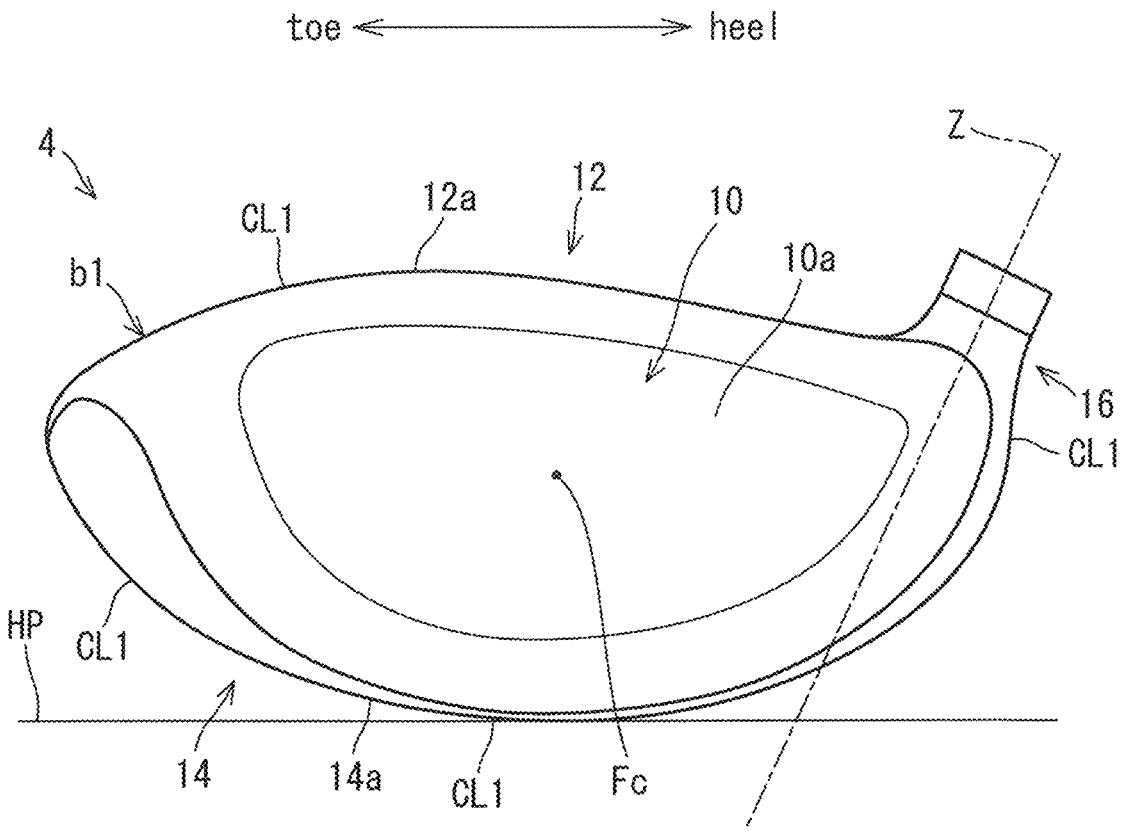
FIG. 2 is a front view of the head of the first embodiment as viewed from a face side.
Figure 3:
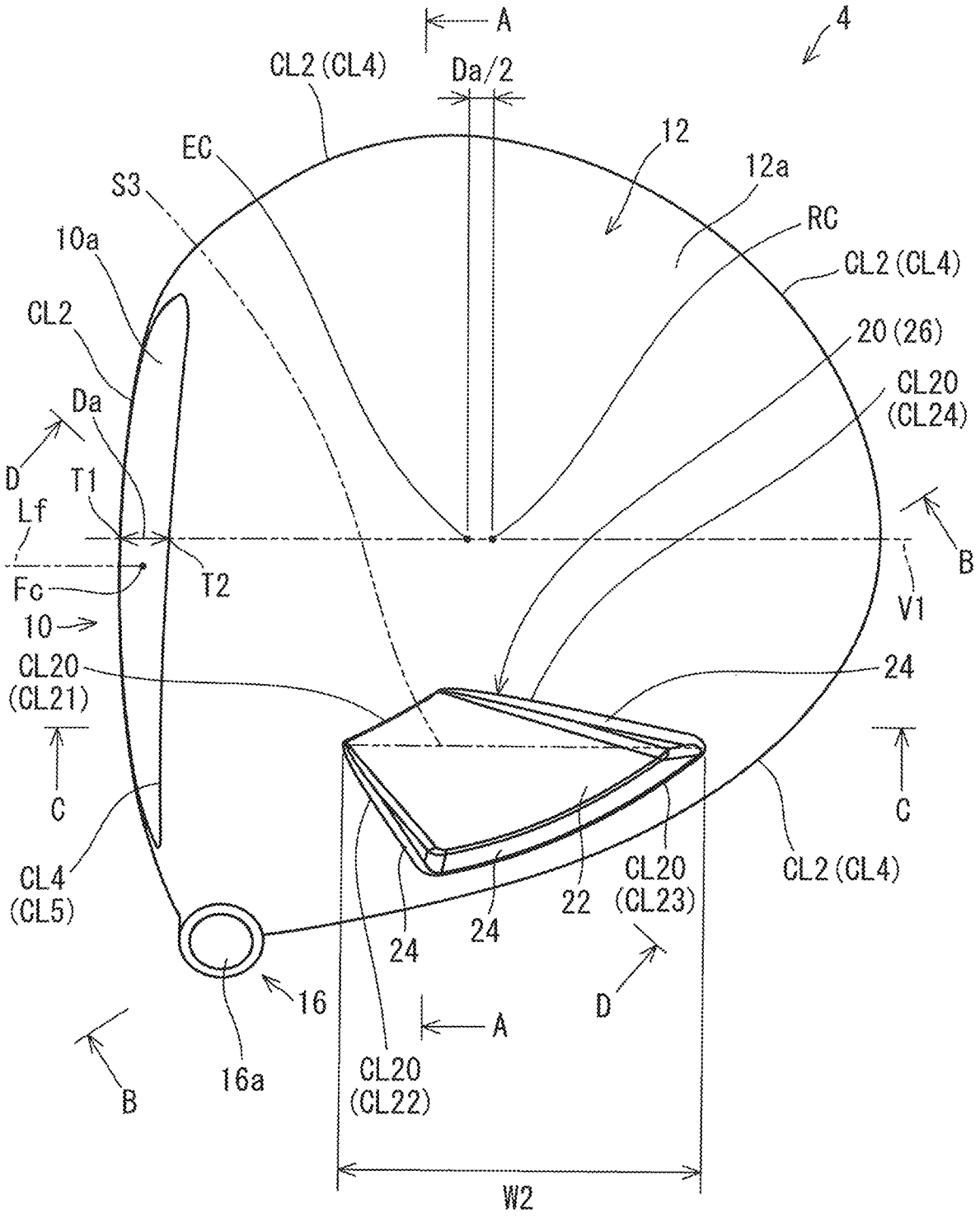
FIG. 3 is a plan view of the head of the first embodiment as viewed from a crown side.
Figure 4:
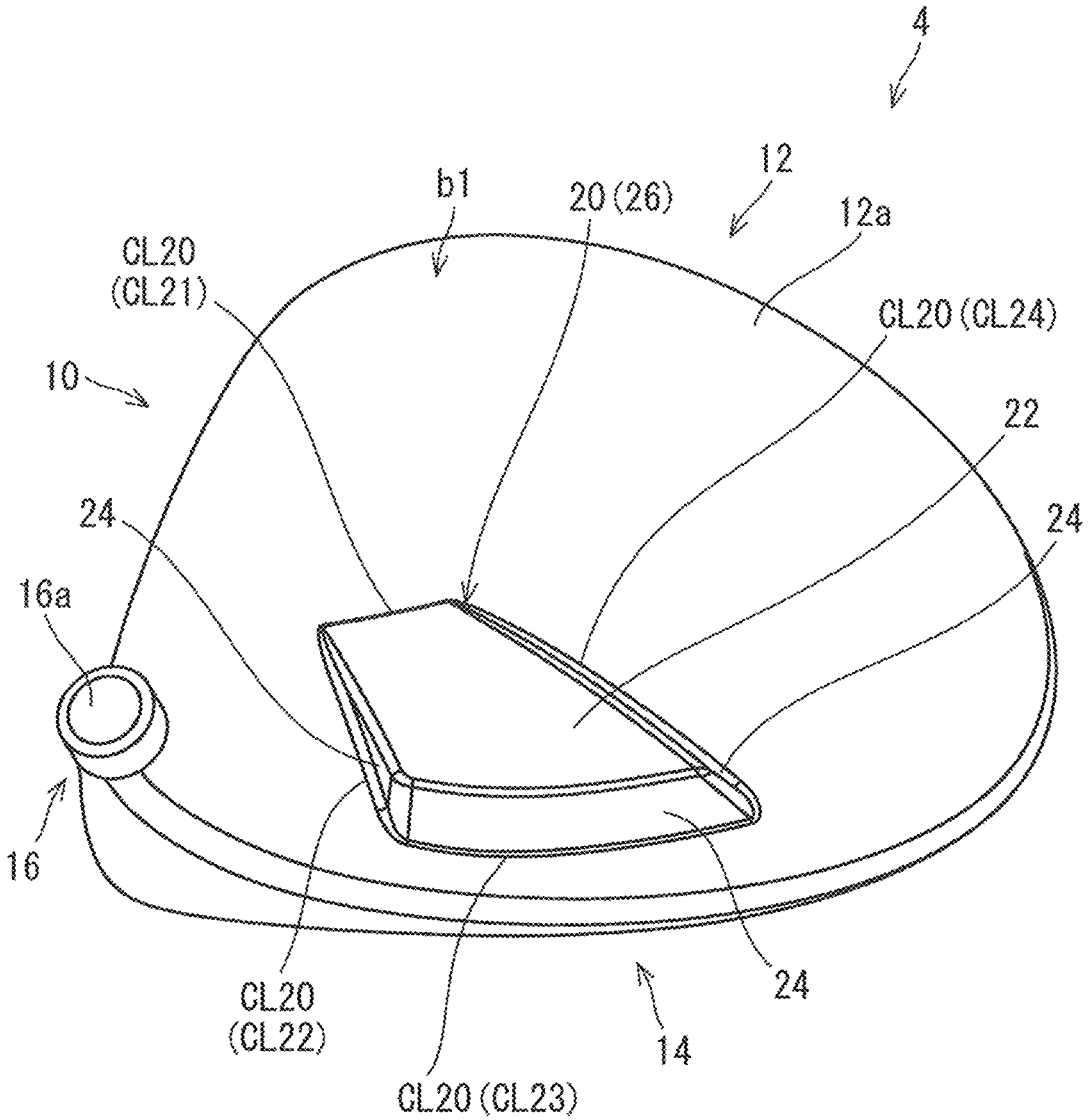
FIG. 4 is a perspective view of the head of the first embodiment as viewed from a heel-back side.

FIG. 1 is an overall view of a golf club 2 that includes a head 4 according to a first embodiment of the present disclosure. FIG. 2 is a front view of the head 4. FIG. 2 shows the head 4 which is in the reference state as viewed from the face side. FIG. 3 is a plan view of the head 4 as viewed from a crown side. FIG. 4 is a perspective view of the head 4 as viewed from a heel-back side.

As shown in FIG. 1, the golf club 2 includes the golf club head 4, a shaft 6, and a grip 8. The shaft 6 includes a tip end Tp and a butt end Bt. The head 4 is attached to a tip end portion of the shaft 6. The grip 8 is attached to a butt end portion of the shaft 6.

The golf club 2 is a driver (No. 1 wood). The head 4 is a driver head. Typically, the club as a driver has a length of greater than or equal to 43 inches. Preferably, the golf club 2 is a wood type golf club.

The shaft 6 is in a tubular form. The shaft 6 is hollow. The material of the shaft 6 is a carbon fiber reinforced resin. From the viewpoint of weight reduction, a carbon fiber reinforced resin is preferable as a material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

The head 4 has a hollow structure. In the present embodiment, the head 4 is a wood type head. The head 4 may be a hybrid type head. The head 4 may be an iron type head. The head 4 may be a putter type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

As shown in FIG. 2 to FIG. 4, the head 4 includes a face portion 10, a crown portion 12, a sole portion 14 and a hosel portion 16. The face portion 10 forms a striking face 10*a* and a face inner surface (not shown in the drawings). The striking face 10*a* is the outer surface of the face portion 10. The striking face 10*a* is also simply referred to as a face or a face surface. The crown portion 12 forms a crown outer surface 12*a* and a crown inner surface 12*b*. The sole portion 14 forms a sole outer surface 14*a* and a sole inner surface 14*b*. The head 4 is hollow. That is, the head 4 includes a hollow portion k1. The face inner surface, the crown inner surface 12*b*, and the sole inner surface 14*b* face the hollow portion k1 of the head 4. The crown inner surface 12*b*, the sole inner surface 14*b* and the hollow portion k1 are shown in cross-sectional views (FIG. 12 and FIG. 14) of the head 4, which are detailed below.

The striking face 10*a* has a face center Fc as defined above.

The crown portion 12 includes a crown atypically-shaped portion 20. The crown atypically-shaped portion 20 is a portion that forms a hollow projection or a hollow recess. In the present embodiment, the crown atypically-shaped portion 20 is a crown projection 26 that forms a projection on the crown outer surface 12*a* and forms a recess on the crown inner surface 12*b*. The crown atypically-shaped portion 20 forms a projection on the crown portion 12 when viewed from outside the head 4, and thus is also referred to as the crown projection 26.

In the front view (FIG. 2) of the head 4 as viewed from the face side, the crown atypically-shaped portion 20 is not viewable. In the front view (FIG. 2) of the head 4 as viewed from the face side, the crown atypically-shaped portion 20 does not constitute any part of an outer contour line CL1 of the head 4. The crown atypically-shaped portion 20 is the crown projection 26, and thus can raise the position of the center of gravity of the head 4. The crown projection 26 is preferably formed at a low position from the viewpoint of not raising the position of the center of gravity of the head while providing the crown projection 26 for obtaining aerodynamic characteristics. In such a case, the crown projection 26 can be provided at a position that is not viewable in the front view of the head 4.

The entirety of the crown atypically-shaped portion 20 is provided in the crown portion 12. As shown in FIG. 3, the head 4 has an outer contour line CL2 in the planar view. The outer contour line CL2 includes a contour line CL4 of the crown portion 12 in the planar view. Excepting contour lines of the face portion 10 and the hosel portion 16, the outer contour line CL2 coincides with the contour line CL4. As shown in FIG. 3, the crown atypically-shaped portion 20 does not reach the contour line CL4. The crown atypically-shaped portion 20 does not extend to other portions than the crown portion 12.

The contour line CL4 of the crown portion 12 includes a contour line CL5 positioned on the face side. In a longitudinal cross section (longitudinal cross section means a cross section taken along the face-back direction) of the outer surface of the head 4, the radius of curvature of the contour line of the head outer surface in the longitudinal cross section (hereinafter, the contour line in the longitudinal cross section is also referred to as a longitudinal cross-sectional contour line) is sequentially observed from the center of the crown outer surface 12*a* toward the face portion 10, and a portion where the radius of curvature becomes less than or equal to 200 mm for the first time is specified. In this portion, a point located at the centermost position of the crown outer surface 12*a* can be a point constituting the contour line CL5. This point can be specified at each position in the toe-heel direction.

The plan view of the head 4 is a projected figure obtained by projecting the head which is in the reference state onto a plane parallel to the ground plane HP. In the present disclosure, the plan view (FIG. 3) of the head 4 is also referred to as a planar view.

In the planar view, the crown atypically-shaped portion 20 may reach the contour line CL4 of the crown portion 12. The crown atypically-shaped portion 20 may form a part of the contour line CL4. The crown atypically-shaped portion 20 may extend into other portion(s) other than the crown outer surface 12*a*. For example, the crown atypically-shaped portion 20 may extend from the crown portion 12 into the sole portion 14. When the head 4 includes a side portion (skirt portion), the crown atypically-shaped portion 20 may extend from the crown portion 12 into the side portion.

The crown outer surface 12*a* includes a base surface b1. Of the crown outer surface 12*a*, a portion in which the crown atypically-shaped portion 20 is not present is formed by the base surface b1. The base surface b1 is a convex curved surface that is smooth and continuous. The convex curved surface is a curved surface that is convex toward the outside of the head 4. As shown in FIG. 3, the base surface b1 belonging to the crown outer surface 12*a* includes a geometric center EC of the head 4 in the plan view. The geometric center EC is the geometric center of a figure indicated by the outer contour line CL2.

The crown portion 12 includes a crown center RC. The crown center RC can be determined based on the geometric center EC. As shown in FIG. 3, a frontmost point (face-most point) T1 of the head 4 and an uppermost point T2 of the face surface 10*a* are determined in the cross-sectional contour line (longitudinal cross-sectional contour line) of the outer surface of the head 4 in a longitudinal cross section V1 that passes through the geometric center EC. The radius of curvature of the longitudinal cross-sectional contour line is sequentially observed from the center of the face surface 10*a* toward the crown portion 12, and a portion where the radius of curvature becomes less than or equal to 200 mm for the first time is specified. In this portion, a point located on the centermost position of the face surface 10*a* can be the uppermost point T2. A distance between the frontmost point T1 and the uppermost point T2 in the face-back direction is denoted by Da. In the plan view of the head 4, a point obtained by moving the geometric center EC toward the back side by half of Da is defined as the crown center RC. Hereinafter, a direction toward the crown center RC and a position closer to the crown center RC is referred to as a crown center side.

Figure 5:
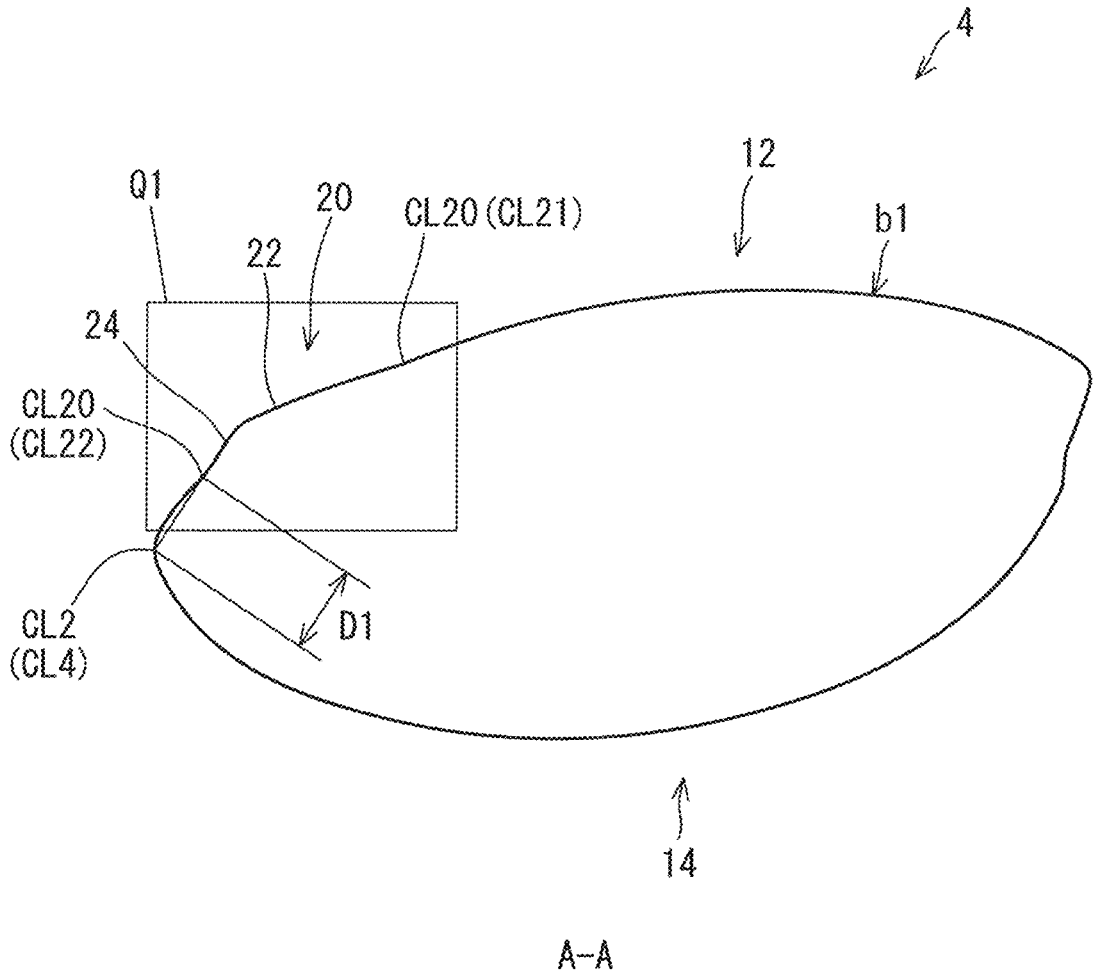
FIG. 5 is a cross-sectional view taken along line A-A in FIG. 3, and shows a cross-sectional contour line of the outer surface of the head.
Figure 6:
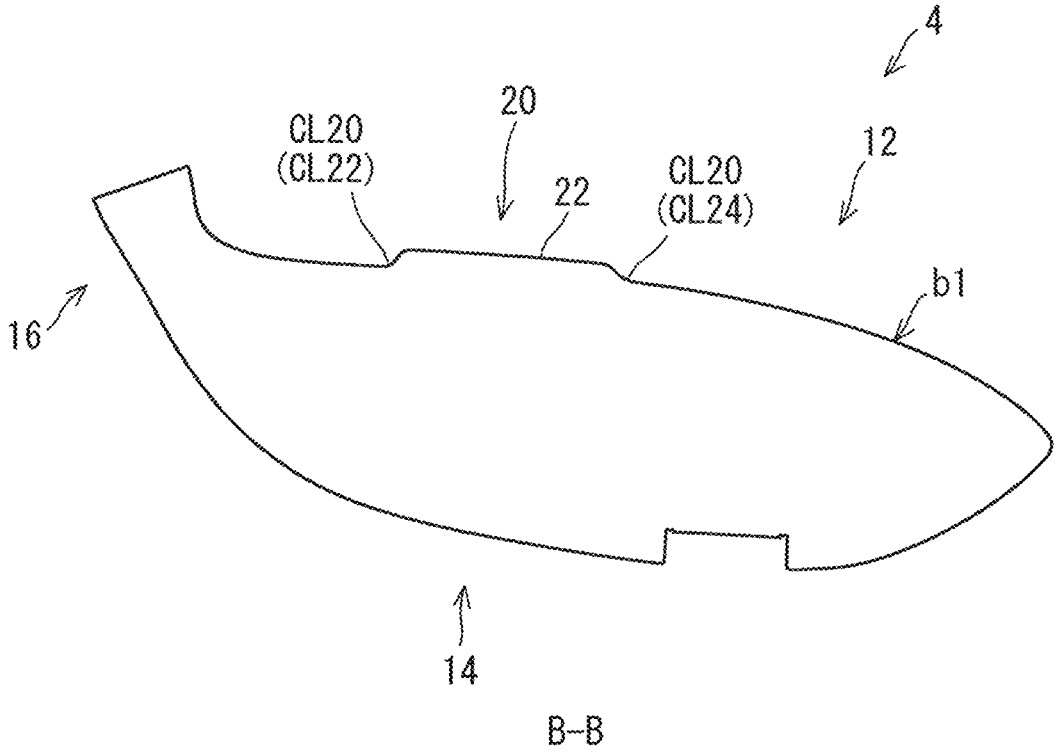
FIG. 6 is a cross-sectional view taken along line B-B in FIG. 3, and shows a cross-sectional contour line of the outer surface of the head.
Figure 7:
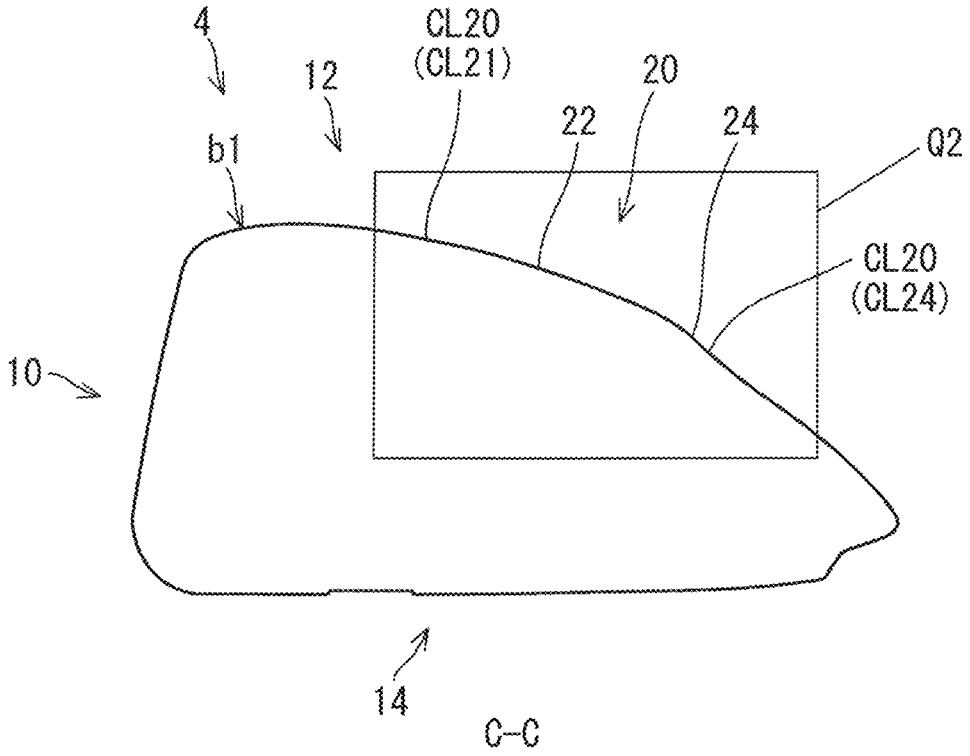
FIG. 7 is a cross-sectional view taken along line C-C in FIG. 3, and shows a cross-sectional contour line of the outer surface of the head.
Figure 8:
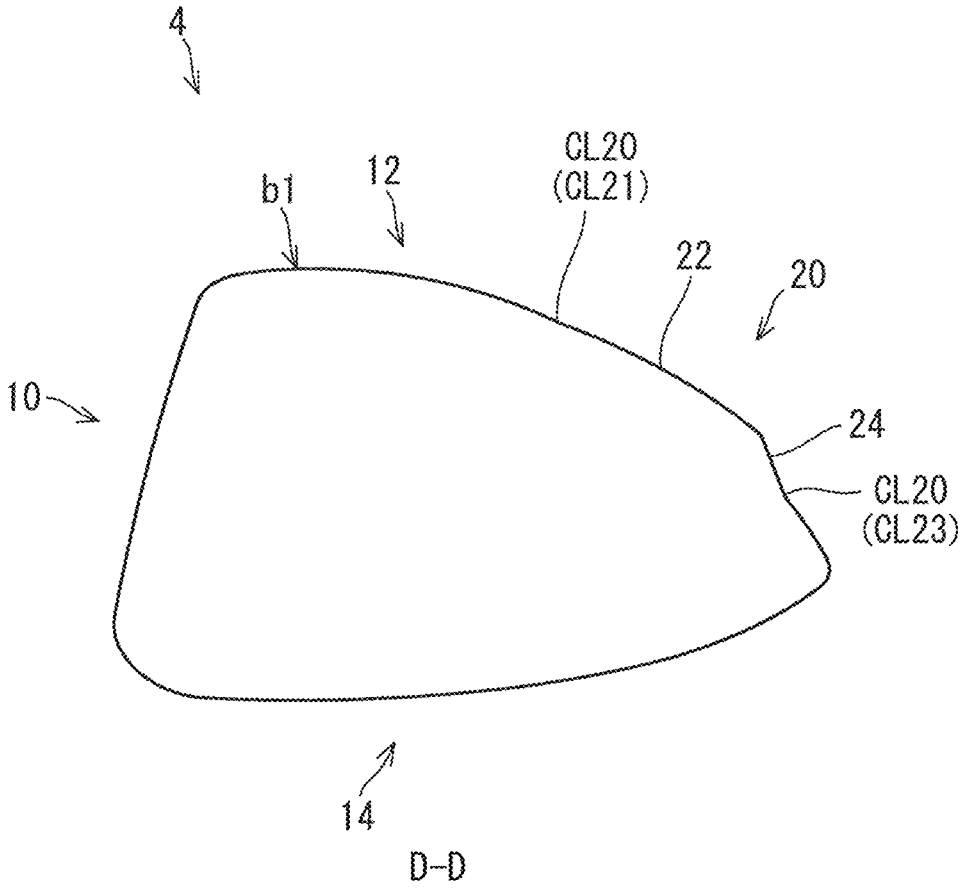
FIG. 8 is a cross-sectional view taken along line D-D in FIG. 3, and shows a cross-sectional contour line of the outer surface of the head.

FIG. 5 shows a cross-sectional contour line of the outer surface of the head 4 in a cross-sectional view taken along line A-A in FIG. 3. FIG. 6 shows a cross-sectional contour line of the outer surface of the head 4 in a cross-sectional view taken along line B-B in FIG. 3. FIG. 7 shows a cross-sectional contour line of the outer surface of the head 4 in a cross-sectional view taken along line C-C in FIG. 3. FIG. 8 shows a cross-sectional contour line of the outer surface of the head 4 in a cross-sectional view taken along line D-D in FIG. 3. FIG. 5 to FIG. 8 each include the cross-sectional contour line of the crown outer surface 12*a*.

The crown atypically-shaped portion 20 includes a contour line CL20, an upper surface 22, and a sidewall surface 24 (see FIG. 3). The contour line CL20 is the contour line of the crown atypically-shaped portion 20 on the crown outer surface 12*a*. The contour line CL20 is a boundary line between the base surface b1 and the crown atypically-shaped portion 20. In the planar view, the contour line CL20 of the crown atypically-shaped portion 20 has a substantially quadrilateral shape (substantially trapezoidal shape) having four sides. In the present disclosure, the word "substantially" means that a shape in question may have a curved side(s) (not straight side(s)) and/or a rounded corner(s). As described above, in the planar view, the side(s) of the crown atypically-shaped portion 20 may be bent. In the planar view, the radius of curvature (allowable radius of curvature) of the curved side(s) is preferably greater than or equal to 25 mm, more preferably greater than or equal to 40 mm, and still more preferably greater than or equal to 50 mm. Of course, each side may be a straight line in the planar view.

When a side is a curved line, a point at which the radius of curvature becomes smaller than the allowable radius of curvature for the first time can be the end of the side. In the planar view, the radius of curvature of each rounded corner (s) is preferably less than or equal to 10 mm, more preferably less than or equal to 7 mm, and still more preferably less than or equal to 5 mm. A substantially quadrilateral shape is formed by the contour line CL20.

It should be noted that there may be a side that cannot be seen in the planar view, such as a third side 63 (see FIG. 16) in a head 50 described below. Even in such a case, the side can be recognized in the planar view by using a hidden line (see-through line) of the side.

The boundary between the upper surface 22 and the sidewall surface 24 can be defined by a ridgeline. The ridgeline can be specified as a point having a radius of curvature of less than or equal to 5 mm or as a vertex of an angular corner in a cross-sectional contour line of the outer surface of the crown atypically-shaped portion 20. Although the radius of curvature of the cross-sectional contour line can vary depending on the direction of the cross section, a cross section that has the smallest radius of curvature is selected for determining the radius of curvature to specify the ridgeline.

As described below, the crown atypically-shaped portion 20 preferably has at least one side. That is, the contour line CL20 preferably has at least one side in the crown outer surface 12*a*. As in the present embodiment, the crown atypically-shaped portion 20 (contour line CL20) may have a substantially polygonal shape. When this substantially polygonal shape is defined as a substantially N-sided polygonal shape, N can be an integer of greater than or equal to 3. N may be an integer that is greater than or equal to 3 and less than or equal to 20.

As shown in FIG. 3, the crown atypically-shaped portion 20 (contour line CL20) has a first side CL21, a second side CL22, a third side CL23 and a fourth side CL24. The first side CL21 constitutes a side on the toe-face side of the crown atypically-shaped portion 20. The first side CL21 extends in such a manner that it goes toward the back side as it goes to the toe side. The first side CL21 connects the second side CL22 and the fourth side CL24.

The second side CL22 constitutes a side on the heel-face side of the crown atypically-shaped portion 20. The second side CL22 extends in such a manner that it goes toward the back side as it goes to the heel side. The second side CL22 connects the first side CL21 and the third side CL23.

The third side CL23 constitutes a side on the heel-back side of the crown atypically-shaped portion 20. The third side CL23 extends in such a manner that it goes toward the back side as it goes to the toe side. The third side CL23 connects the second side CL22 and the fourth side CL24. The third side CL23 constitutes a curved line that projects toward the outside of the head 4.

The fourth side CL24 constitutes a side on the toe-back side of the crown atypically-shaped portion 20. The fourth side CL24 extends in such a manner that it goes toward the back side as it goes to the heel side. The fourth side CL24 connects the third side CL23 and the first side CL21.

The second side CL22, the third side CL23, and the fourth side CL24 constitute a starting line of the sidewall surface 24. That is, the second side CL22, the third side CL23, and the fourth side CL24 constitute the boundary line between the sidewall surface 24 and the base surface b1. On the other hand, the first side CL21 does not constitute a starting line of the sidewall surface 24. The first side CL21 constitutes the boundary line between the base surface b1 and the upper surface 22.

In the present disclosure, a cross-sectional contour line in a cross section taken along the toe-heel direction is also simply referred to as a transverse cross-sectional contour line. FIG. 5 shows an example of the transverse cross-sectional contour line. A transverse cross-sectional contour line of the outer surface of the head 4 is also simply referred to as a transverse cross-sectional contour line. In the present disclosure, a cross-sectional contour line in a cross section taken along the face-back direction is also simply referred to as longitudinal cross-sectional contour line. FIG. 7 shows an example of the longitudinal cross-sectional contour line. A longitudinal cross-sectional contour line of the outer surface of the head 4 is also simply referred to as a longitudinal cross-sectional contour line.

An inflection point in the transverse cross-sectional contour line can be a point that forms the contour line CL20. In other words, this inflection point can be a starting point of the crown atypically-shaped portion 20. The transverse cross-sectional contour line of the base surface b1 is a curved line that projects toward the outside of the head 4. The inflection point is a point at which the curved line that projects toward the outside of the head 4 changes into a curved line that projects toward the inside of the head 4.

A vertex of an angular corner in the transverse cross-sectional contour line can be a point that forms the contour line CL20. In other words, this vertex can be a starting point of the crown atypically-shaped portion 20. The transverse cross-sectional contour line of the base surface b1 is a curved line that projects toward the outside of the head 4. A line that is connected to this curved line, makes an angle, and extends toward the outside of the head 4 forms a vertex. This vertex points toward the inside of the head 4. This vertex can be the starting point of the crown atypically-shaped portion 20.

An inflection point of in the longitudinal cross-sectional contour line can be a point that forms the contour line CL20. In other words, this inflection point can be a starting point of the crown atypically-shaped portion 20. The longitudinal cross-sectional contour line of the base surface b1 is a curved line that projects toward the outside of the head 4. The inflection point is a point at which the curved line that projects toward the outside of the head 4 changes into a curved line that projects toward the inside of the head 4.

A vertex of an angular corner of in the longitudinal cross-sectional contour line can be a point that forms the contour line CL20. In other words, this vertex can be a starting point of the crown atypically-shaped portion 20. The longitudinal cross-sectional contour line of the base surface b1 is a curved line that projects toward the outside of the head 4. A line that is connected to this curved line, makes an angle, and extends toward the outside of the head 4 forms a vertex. This vertex points toward the inside of the head 4. This vertex can be the starting point of the crown atypically-shaped portion 20.

Typically, the contour line CL20 can be determined by the inflection points or the vertices. For determining the contour line CL20, the transverse cross-sectional contour line may be selected in preference to the longitudinal cross-sectional contour line. In this case, the transverse cross-sectional contour line is used for specifying the inflection point or the vertex. When it is difficult to specify the inflection point or the vertex by using the transverse cross-sectional contour line, the longitudinal cross-sectional contour line can be used. When the contour line of the crown atypically-shaped portion 20 can be visually and clearly recognized, the contour line can be determined as the contour line CL20.

The crown atypically-shaped portion 20 is a portion that protrudes from the base surface b1. A virtually extended surface b2 that is obtained by extending the base surface b1 can be specified on the lower side of the crown atypically-shaped portion 20. The crown atypically-shaped portion 20 is a portion that protrudes relative to the virtually extended surface b2. The virtually extended surface b2 can be considered, if no crown atypically-shaped portion 20 is present, as a part of the base surface b1 formed in a region in which the crown atypically-shaped portion 20 would be installed. The virtually extended surface b2 is formed so as to be continuous with the base surface b1. The virtually extended surface b2 is a curved surface that is convex toward the outside of the head 4. The virtually extended surface b2 is smoothly continuous with the base surface b1.

Figure 9:
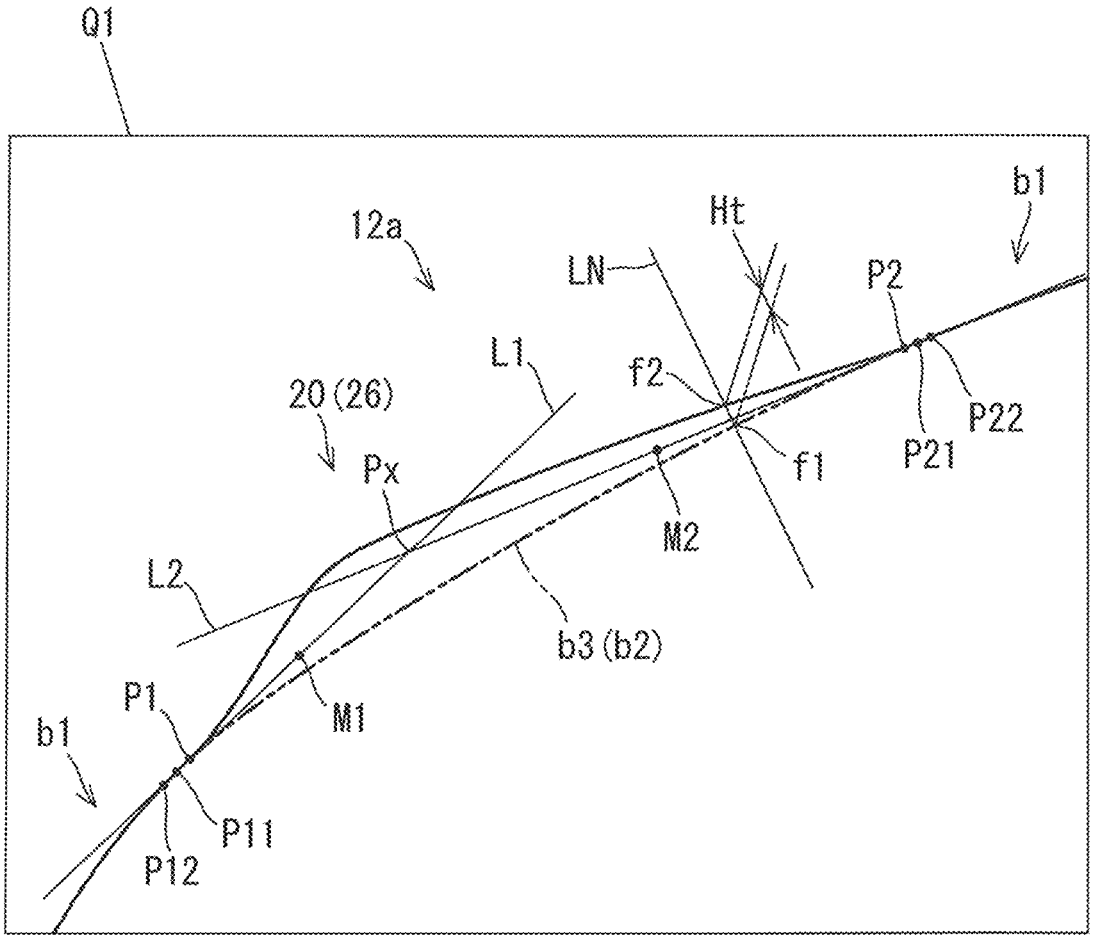
FIG. 9 is an enlarged view of a portion surrounded by a tetragon Q1 in FIG. 5, and a virtually extended line of a crown base surface is additionally drawn in FIG. 9.
Figure 10:
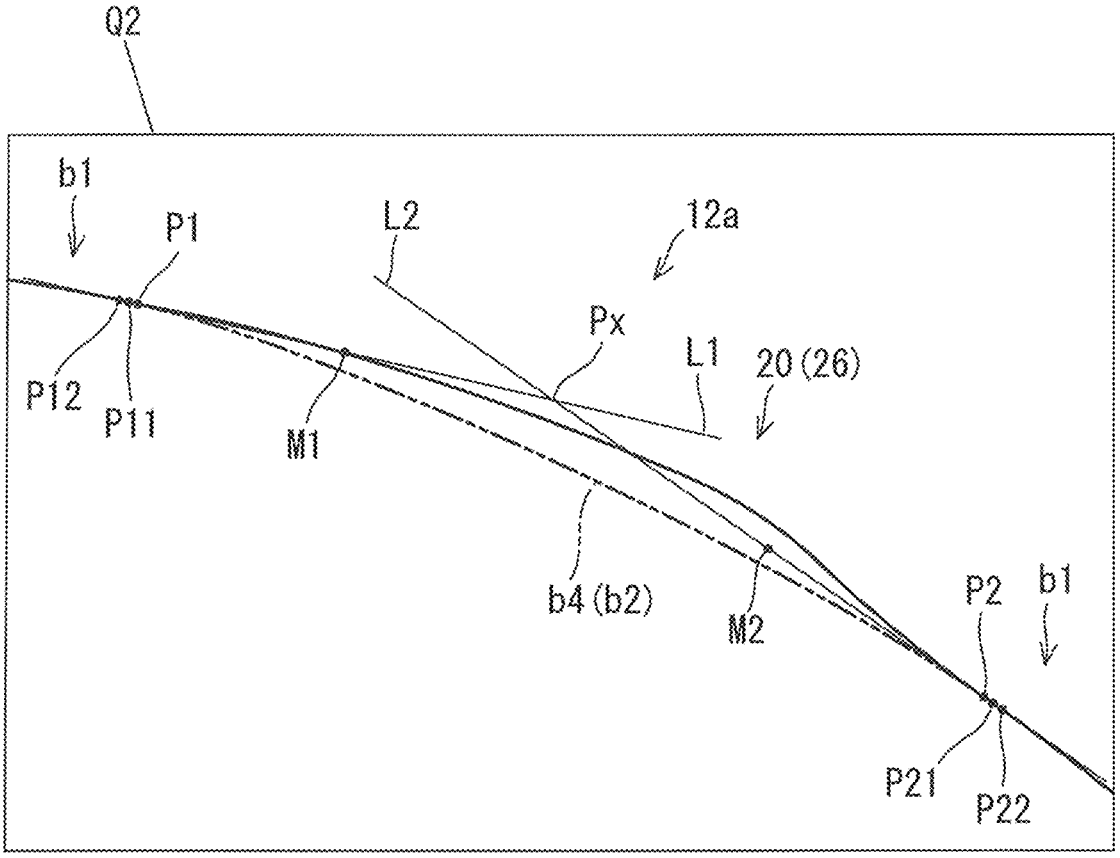
FIG. 10 is an enlarged view of a portion surrounded by a tetragon Q2 in FIG. 7, and a virtually extended line of a crown base surface is additionally drawn in FIG. 10.

FIG. 9 is an enlarged view of a portion that is surrounded by a tetragon Q1 in FIG. 5. FIG. 10 is an enlarged view of a portion that is surrounded by a tetragon Q2 in FIG. 7.

FIG. 9 shows the transverse cross-sectional contour line with a virtually extended line b3 that can form the virtually extended surface b2. The virtually extended line b3 is a curved line that projects toward the outside of the head 4. The virtually extended line b3 is smoothly continuous with the transverse cross-sectional contour line of the base surface b1. The virtually extended surface b2 can be formed by a set of virtually extended lines b3.

The virtually extended line b3 smoothly connects the transverse cross-sectional contour line of the base surface b1 on one side of the crown atypically-shaped portion 20 and the transverse cross-sectional contour line of the base surface b1 on the other side of the crown atypically-shaped portion 20. The virtually extended line b3 can be drawn as a Bezier curve. A quadratic Bezier curve and a cubic Bezier curve are known as the Bezier curve. In the quadratic Bezier curve, the number of control points is one (excluding a starting point and an end point). In the cubic Bezier curve, the number of control points is two (excluding a starting point and an end point). The cubic Bezier curve is preferably used. Bezier curves drawn in FIG. 9 and FIG. 10 are cubic Bezier curves.

As shown in FIG. 9, the transverse cross-sectional contour line has a first starting point P1 and a second starting point P2. The first starting point P1 and the second starting point P2 are located on the contour line CL20.

Points P11 and P12 that are located on the opposite side of the first starting point P1 from the crown atypically-shaped portion 20 are plotted in order to define an effective tangent line to the transverse cross-sectional contour line at the first starting point P1. The point P11 is a point located 0.5 mm apart from the first starting point P1. The point P12 is a point located 0.5 mm apart from the point P11. These distances of "0.5 mm" for these points are route lengths measured along the transverse cross-sectional contour line. The points P11 and P12 are located on the transverse cross-sectional contour line. A tangent line L1 at the point P1 to a circle that passes through these three points P1, P11 and P12 is determined. When the points P1, P11 and P12 are positioned on a single straight line, this straight line can be determined as the tangent line L1.

Similarly, points P21 and P22 that are located on the opposite side of the second starting point P2 from the crown atypically-shaped portion 20 are plotted in order to define an effective tangent line to the transverse cross-sectional contour line at the second starting point P2. The point P21 is a point located 0.5 mm apart from the second starting point P2. The point P22 is a point located 0.5 mm apart from the point P21. These distances of "0.5 mm" for these points are route lengths measured along the transverse cross-sectional contour line. The points P21 and P22 are located on the transverse cross-sectional contour line. A tangent line L2 at the point P2 to a circle that passes through these three points P2, P21 and P22 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 9, a Bezier curve drawn in this manner is the virtually extended line b3. Because of having two control points, this Bezier curve is a cubic Bezier curve.

The virtually extended line b3 can be defined at any position in the face-back direction. The virtually extended surface b2 can be defined as the set of these virtually extended lines b3.

A similar Bezier curve can be defined in the longitudinal cross-sectional contour line. As shown in FIG. 10, the longitudinal cross-sectional contour line has a first starting point P1 and a second starting point P2. The first starting point P1 and the second starting point P2 are located on the contour line CL20.

Points P11 and P12 that are located on the opposite side of the first starting point P1 from the crown atypically-shaped portion 20 are plotted in order to define an effective tangent line to the longitudinal cross-sectional contour line at the first starting point P1. The point P11 is a point located 0.5 mm apart from the first starting point P1. The point P12 is a point located 0.5 mm apart from the point P11. These distances of "0.5 mm" for these points are route lengths measured along the longitudinal cross-sectional contour line. The points P11 and P12 are located on the longitudinal cross-sectional contour line. A tangent line L1 at the point P1 to a circle that passes through these three points P1, P11 and P12 is determined. When the points P1, P11 and P12 are positioned on a single straight line, this straight line can be determined as the tangent line L1.

Similarly, points P21 and P22 that are located on the opposite side of the second starting point P2 from the crown atypically-shaped portion 20 are plotted in order to define an effective tangent line to the longitudinal cross-sectional contour line at the second starting point P2. The point P21 is a point located 0.5 mm apart from the second starting point P2. The point P22 is a point located 0.5 mm apart from the point P21. These distances of "0.5 mm" for these points are route lengths measured along the longitudinal cross-sectional contour line. The points P21 and P22 are located on the longitudinal cross-sectional contour line. A tangent line L2 at the point P2 to a circle that passes through these three points P2, P21 and P22 is determined. When the points P2, P21 and P22 are positioned on a single straight line, this straight line can be determined as the tangent line L2.

When the tangent line L1 and the tangent line L2 are determined, then an intersection point Px between the tangent line L1 and the tangent line L2 is specified. Furthermore, a middle point M1 between the point P1 and the point Px is specified, and a middle point M2 between the point P2 and the point Px is specified.

A Bezier curve can be drawn by using the point P1 as the starting point, the middle point M1 as the first control point, the middle point M2 as the second control point, and the point P2 as the end point. In FIG. 10, a Bezier curve drawn in this manner is a virtually extended line b4.

The virtually extended line b4 can be defined at any position in the toe-heel direction. The virtually extended surface b2 can be defined as the set of these virtually extended lines b4.

In some cases, the crown atypically-shaped portion may reach an outer peripheral edge (contour line CL4) of the crown portion. In such a case, the number of the starting point(s) of the crown atypically-shaped portion which is/are formed on the boundary between the crown atypically-shaped portion and the base surface b1 can be only one in the transverse cross-sectional contour line and/or the longitudinal cross-sectional contour line. When only one starting point is present as in this case, a circular arc that is drawn so as to path through the starting point and have a radius of curvature at the starting point can be the virtually extended line b3. That is, in this case, the virtually extended line b3 can be a circle that passes through the following three points: a first point that is the starting point; a second point located 0.5 mm apart from the first point; and a third point located 0.5 mm apart from the second point.

For determining the virtually extended surface b2, the transverse cross-sectional contour line may be used in preference to the longitudinal cross-sectional contour line. The virtually extended surface b2 can be determined as a set of the virtually extended lines b3 obtained from the transverse cross-sectional contour lines. When the virtually extended surface b2 is not clearly determined by the set of the virtually extended lines b3, the virtually extended surface b2 may be determined as a set of the virtually extended lines b4 obtained from the longitudinal cross-sectional contour lines.

A height Ht of the crown atypically-shaped portion 20 can be defined as a height from the virtually extended surface b2. As shown in FIG. 9, a normal line LN that is normal to the virtually extended surface b2 at a certain point f1 has an intersection point f2 at which the normal line LN intersects the outer surface of the crown atypically-shaped portion 20. A distance between the point f1 and the intersection point f2 can be defined as the height Ht of the crown atypically-shaped portion 20 at the intersection point f2. When the crown atypically-shaped portion does not intersect the normal line LN of the virtually extended surface b2 and has a point at which the crown atypically-shaped portion intersects a normal line that is normal to the base surface b1, the height Ht of the crown atypically-shaped portion at the point is defined as a height from the base surface b1. Also in this case, the length of the normal line is the height Ht. When the crown atypically-shaped portion 20 forms a recess on the crown outer surface 12*a*, the height Ht of the crown atypically-shaped portion 20 is defined as the height from the virtually extended surface b2. In this case, the intersection point f2 is an intersection point between the normal line and the inner surface of the crown atypically-shaped portion. The maximum value of the height Ht is the maximum height of the crown atypically-shaped portion 20.

As explained above, when the crown atypically-shaped portion 20 is the crown projection 26 that forms a projection on the crown outer surface 12*a*, the virtually extended surface b2 and the contour line CL20 can be determined. Similarly, when the crown atypically-shaped portion 20 is a crown recess that forms a recess on the crown outer surface 12*a*, the virtually extended surface b2 and the contour line CL20 can be determined. Also when the crown atypically-shaped portion 20 is the crown recess, the contour line CL20 of the crown atypically-shaped portion 20 can be determined on the crown outer surface 12*a*. In this case, however, points that constitute the contour line CL20 including the points P1 and P2 are not inflection points on the cross-sectional contour line of the crown outer surface 12*a*. This is because, when a recess is formed on the crown outer surface 12*a*, a round corner in which the starting point of the recess is present is a curved line that projects toward the outside of the head 4 as with the base surface b1. From this viewpoint, when the crown atypically-shaped portion 20 is the crown recess, points that constitute the contour line CL20 can be considered as portions (points) having the smallest radius of curvature or as vertices of angular corners in cross-sectional contour lines. In the case where the portion having the smallest radius of curvature is a circular arc, the midpoint of the circular arc can be the point constituting the contour line CL20. Excepting this matter, the methods for determining the contour line CL20 and the virtually extended surface b2 of the crown recess are the same as those of the crown projection.

Figure 11:
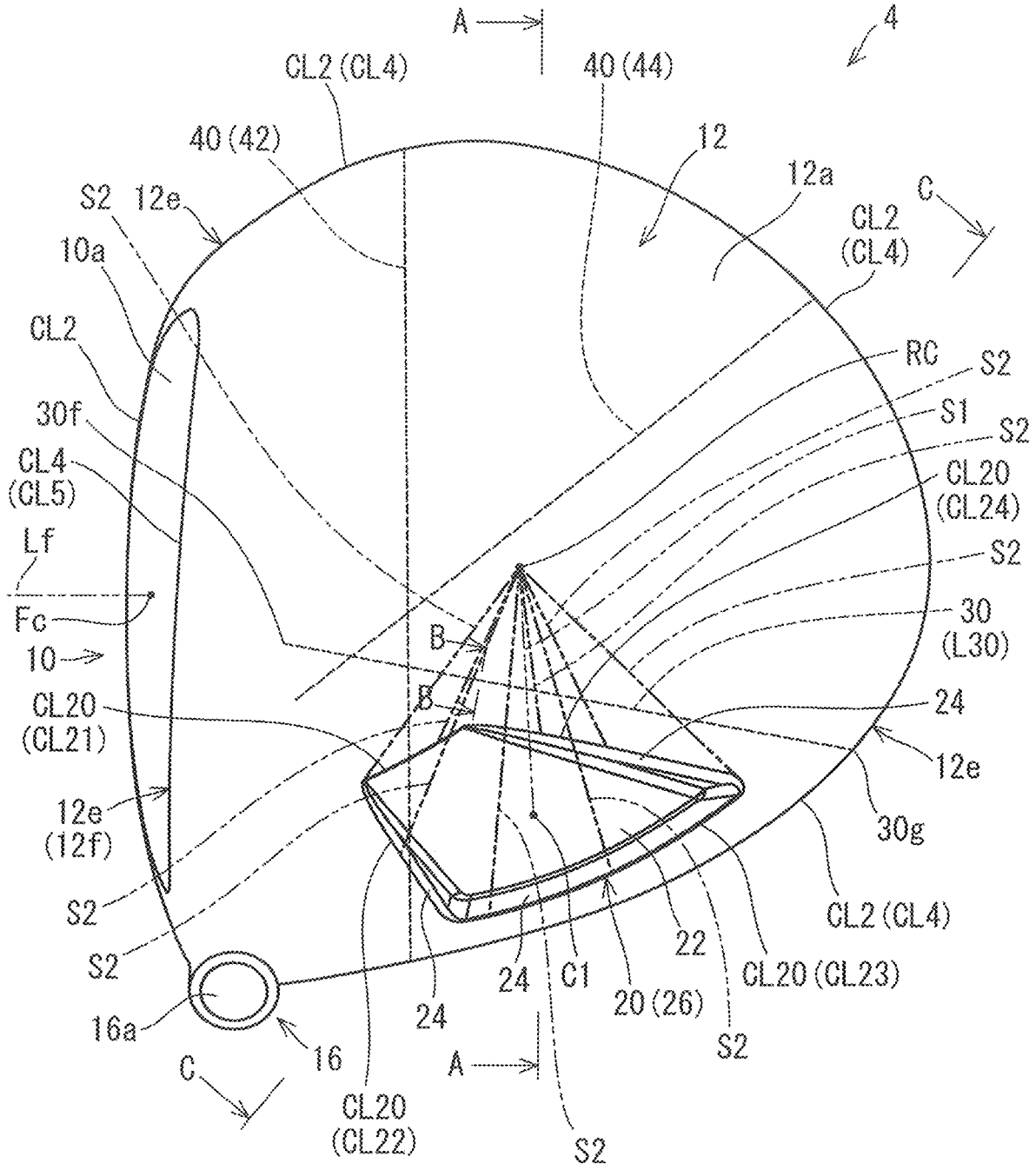
FIG. 11 is the same plan view as FIG. 3.
Figure 12:
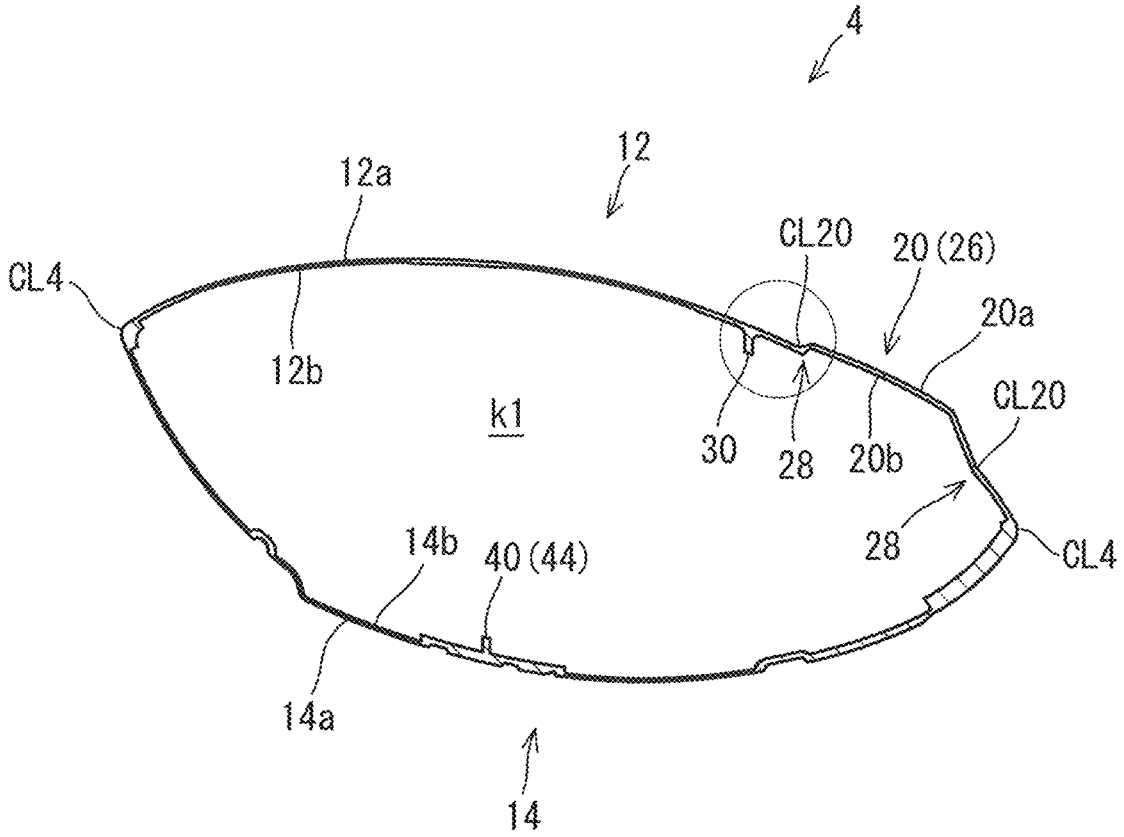
FIG. 12 is a cross-sectional view taken along line A-A in FIG. 11.
Figure 13A:
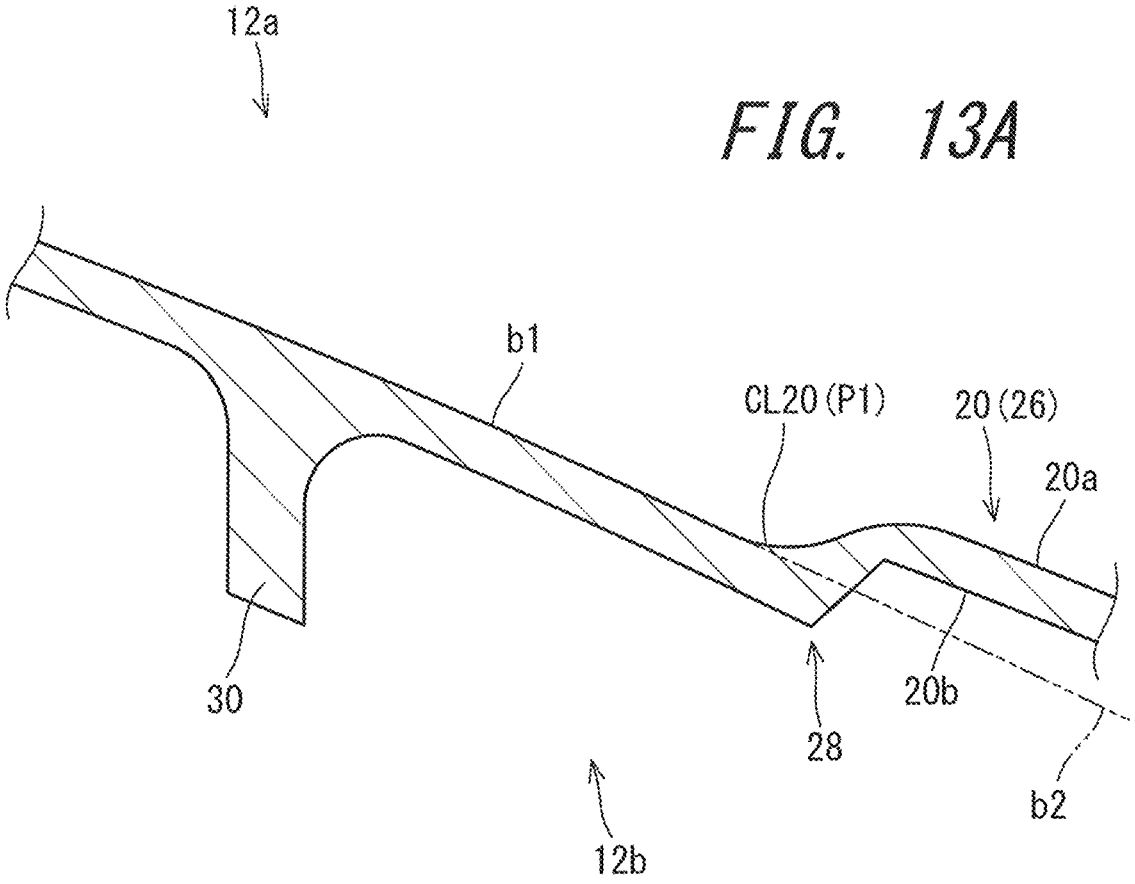
FIG. 13A is an enlarged view of a portion shown within the circle of FIG. 12.
Figure 13B:
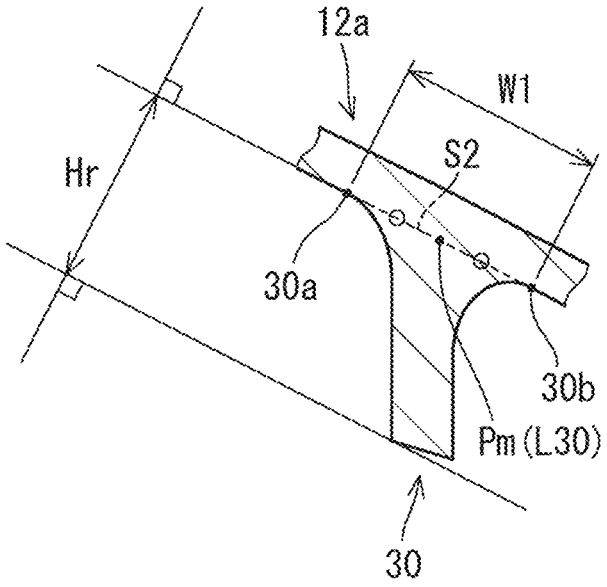
FIG. 13B is a cross-sectional view taken along line B-B in FIG. 11.
Figure 14:
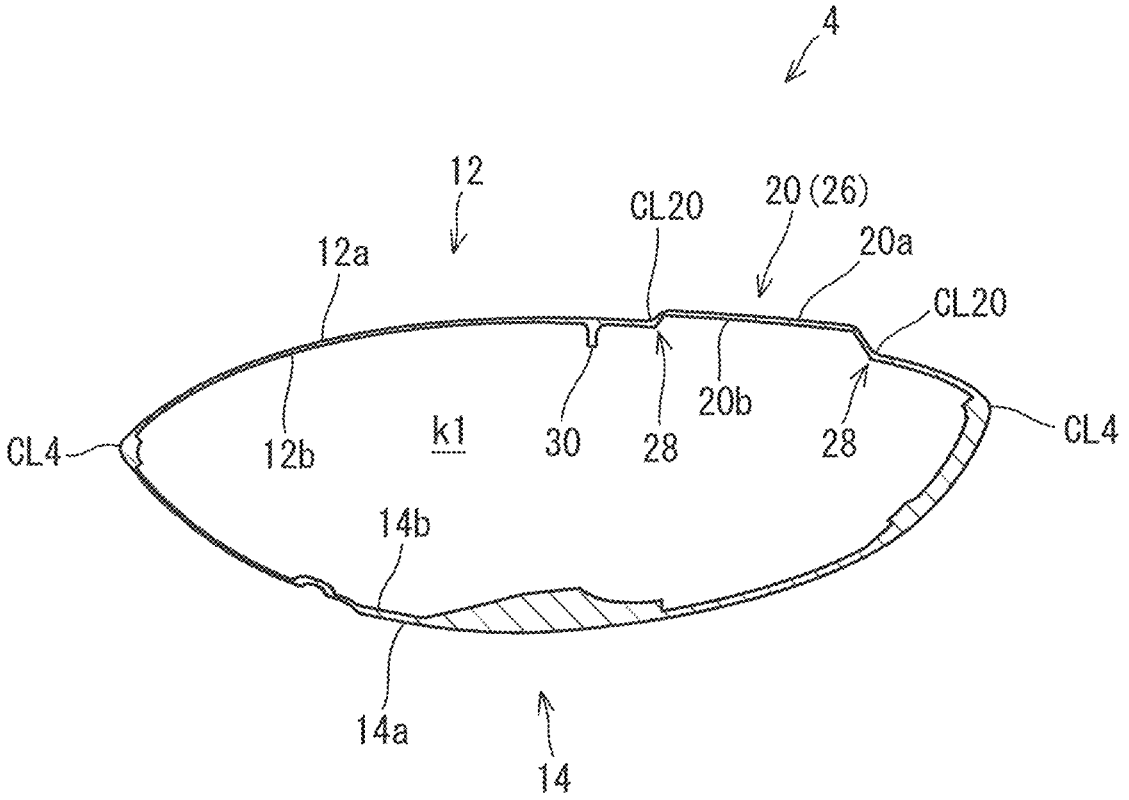
FIG. 14 is a cross-sectional view taken along line C-C in FIG. 11.
Figure 15:
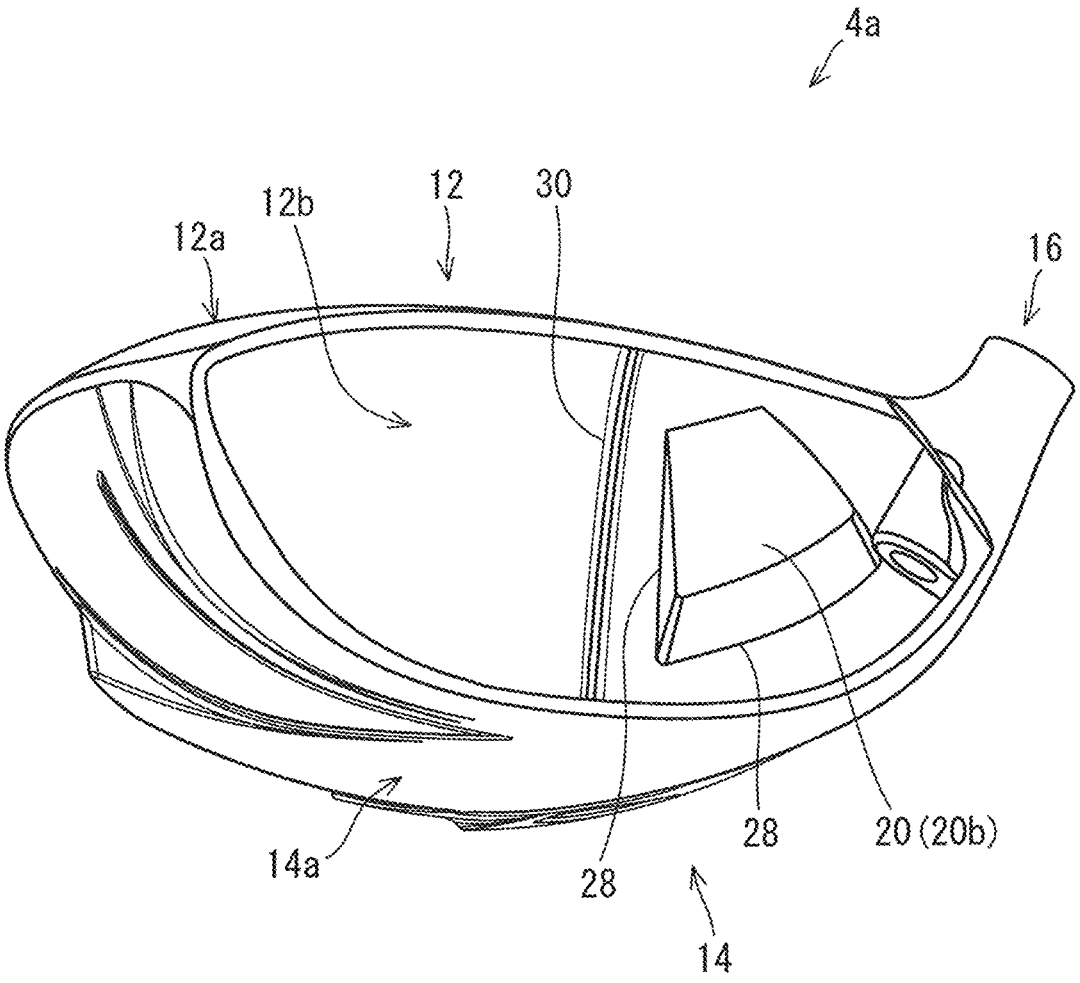
FIG. 15 is a perspective view of a head body of the head according to the first embodiment.

FIG. 11 is the plan view of the head 4 as with FIG. 3. FIG. 11 additionally shows a crown rib 30 and a sole rib 40 provided on the inner surface of the head 4 with dashed lines. The crown rib 30 and the sole rib 40 in FIG. 11 are schematically illustrated by indicating only rib center lines L30 and L40 of the respective ribs. FIG. 12 is a cross-sectional view taken along line A-A in FIG. 11. FIG. 13A is an enlarged view of a portion shown within the circle of FIG. 12. FIG. 13B is a cross-sectional view taken along line B-B in FIG. 11. FIG. 14 is a cross-sectional view taken along line C-C in FIG. 11. FIG. 15 is a perspective view of a head body 4*a* of the head 4. In the head 4, a face member (not shown) and the head body 4*a* are joined (welded) to each other. In FIG. 14, the inside of the head 4 is viewable.

As shown in FIG. 12 and FIG. 13A, the crown atypically-shaped portion 20 forms the projection 20*a* on the crown outer surface 12*a* while forming the recess 20*b* on the crown inner surface 12*b*. The recess 20*b* is also referred to as an inner surface recess. The projection 20*a* is also referred to as an outer surface projection. The inner surface recess 20*b* is recessed to correspond to the outer surface projection 20*a*. As shown in FIG. 13A, the inner surface recess 20*b* has a portion located on the outer side (outer side of the head 4) relative to the virtually extended surface b2.

In the crown portion 12, a bent portion 28 is formed along the contour line CL20 of the crown atypically-shaped portion 20. The bent portion 28 is formed by bending a wall forming the crown portion 12. The bent portion 28 may be angled or may be curved. In the crown outer surface 12*a*, the contour line CL20 is a starting point of bending of the bent portion 28. The wall thickness of the crown atypically-shaped portion 20 is substantially the same as the wall thickness of the crown portion 12 in the vicinity of the crown atypically-shaped portion 20. Since the inner surface recess 20*b* is formed on the reverse side of the outer surface projection 20*a*, the bent portion 28 is formed. In the embodiment of FIG. 13A, the bent portion 28 forms a rounded corner on the crown outer surface 12*a* and forms an angular corner on the crown inner surface 12*b*. The bent portion 28 may form a rounded corner both on the crown outer surface 12*a* and the crown inner surface 12*b*. The bent portion 28 may form an angular corner both on the crown outer surface 12*a* and the crown inner surface 12*b*. The bent portion 28 may form an angular corner on the crown outer surface 12*a*, and may form a rounded corner on the crown inner surface 12*b*.

As shown with a dashed line in FIG. 11, the crown portion 12 includes the rib 30. The rib 30 is provided on the crown inner surface 12*b*. The rib 30 is also referred to as a crown rib. The crown portion 12 including the crown rib 30 is integrally formed as a single piece member.

The crown rib 30 is provided at a position different from the position of the crown atypically-shaped portion 20. The crown rib 30 is located apart from the crown atypically-shaped portion 20. The crown rib 30 does not intersect the crown atypically-shaped portion 20. The crown rib 30 may intersect the crown atypically-shaped portion 20.

In the present embodiment, the number of the crown rib 30 is one. A plurality of crown ribs 30 may be provided.

As shown with dashed lines in FIG. 11, the rib 40 is provided in the sole portion 14. As shown in FIG. 12, the rib 40 is provided on the sole inner surface 14*b*. The rib 40 is also referred to as a sole rib. The sole rib 40 includes a first sole rib 42 and a second sole rib 44. The first sole rib 42 and the second sole ribs 44 intersect each other. The number of the sole ribs 40 may be one or may be plural as in the present embodiment.

As shown in FIG. 11, the crown rib 30 is positioned on the crown center side relative to a center C1 of the crown atypically-shaped portion 20. That is, in the planar view, a line segment S1 that extends from the center C1 to the crown center RC intersects the crown rib 30. The center C1 of the crown atypically-shaped portion 20 means the geometric center (center of figure) of the contour line CL20 in the planar view. In a planar view of the golf club head 4, the crown rib 30 is disposed such that a virtual line representing the crown rib 30 intersects all virtual line segments that connect the crown center RC and all points located on the contour line CL of the crown atypically-shaped portion 20 that defines an overall shape of the crown atypically-shaped portion 20 in the planar view.

The crown rib 30 is positioned on the crown center side relative to the entirety of the crown atypically-shaped portion 20. That is, in the planar view, the crown rib 30 is disposed between the contour line CL20 of the crown atypically-shaped portion 20 and the crown center RC. In the planar view, the crown rib 30 intersects the line segment S1 extending from the center C1 to the crown center RC, and does not intersect the crown atypically-shaped portion 20.

The contour line CL20 of the crown atypically-shaped portion 20 has at least one side. As described above, in the present embodiment, the contour line CL20 has four sides CL21 to CL24. These sides CL21 to CL24 include a specific side CL24 that is positioned on the crown center side relative to the center C1 of the crown atypically-shaped portion 20. In the planar view, a side that intersects the line segment S1 is defined as the specific side.

FIG. 13B is a cross-sectional view taken along line B-B in FIG. 11. The line B-B extends in a width direction of the crown rib 30. The crown rib 30 has a first starting point 30*a* and a second starting point 30*b*. A line segment S2 that extends from the first starting point 30*a* to the second starting point 30*b* is determined. The length of the line segment S2 is defined as a rib base width W1. The width direction is a direction in which the rib base width W1 is at the minimum value. In each cross section taken along the width direction, a middle point Pm of the line segment S2 is determined. The set of the middle points Pm is the rib center line L30.

A double-pointed arrow Hr in FIG. 13B shows the height of the crown rib 30. The height Hr is measured in a cross section taken along the width direction. The height Hr is measured in a direction that is perpendicular to the line segment S2. The height Hr is the height measured from the line segment S2.

The crown rib 30 extends substantially parallel to the specific side CL24. That is, in the planar view, an angle formed between the rib center line L30 of the crown rib 30 and the specific side CL24 is 0°±10°. In other words, this angle is greater than or equal to −10° and less than or equal to +10°. For determining this angle, when the rib center line L30 is a curved line, a tangent line at each point on the curved line is taken into consideration. Similarly, for determining the angle, when the specific side CL24 is a curved line, a tangent line at each point on the curved line is taken into consideration. When the above angle is 0°±10° in every tangent line, the crown rib 30 and the specific side CL24 are substantially parallel to each other. More preferably, in the planar view, the angle formed between the rib center line L30 and the specific side CL24 is 0°±7° (greater than or equal to −7° and less than or equal to 7°). More preferably, in the planar view, the angle formed between the rib center line L30 and the specific side CL24 is 0°±5° (greater than or equal to −5° and less than or equal to) 5°.

At least one end of the crown rib 30 is located in an outer edge portion 12*e* of the crown portion 12. In the planar view, a region that extends from the contour line CL4 of the crown portion 12 to a position 10 mm apart (in shortest distance) from the contour line CL4 is the outer edge portion 12*e*. The outer edge portion 12*e* includes an outer edge portion 12*f* that extends from the contour line CL5 on the face side of the crown portion 12 to a position 10 mm apart (in shortest distance) from the contour line CL5. As shown in FIG. 11, the crown rib 30 has a back-side end 30*g* and a face-side end 30*f*. In the present embodiment, only one of the two ends of the crown rib 30 is located in the outer edge portion 12*e*. In the present embodiment, the back-side end 30*g* is located in the outer edge portion 12*e*. On the other hand, the face-side end 30*f* is not located in the outer edge portion 12*e*. The face-side end 30*f* is located on the back side relative to the outer edge portion 12*f*.

In the head 4, the entirety of the crown atypically-shaped portion 20 is disposed in a region that extends from the contour line CL4 of the crown portion 12 to a position 40 mm apart from the contour line CL4. That is, in the planar view, all points on the contour line CL20 of the crown atypically-shaped portion 20 have a distance (shortest distance) from the contour line CL4 of less than or equal to 40 mm.

Figure 16:
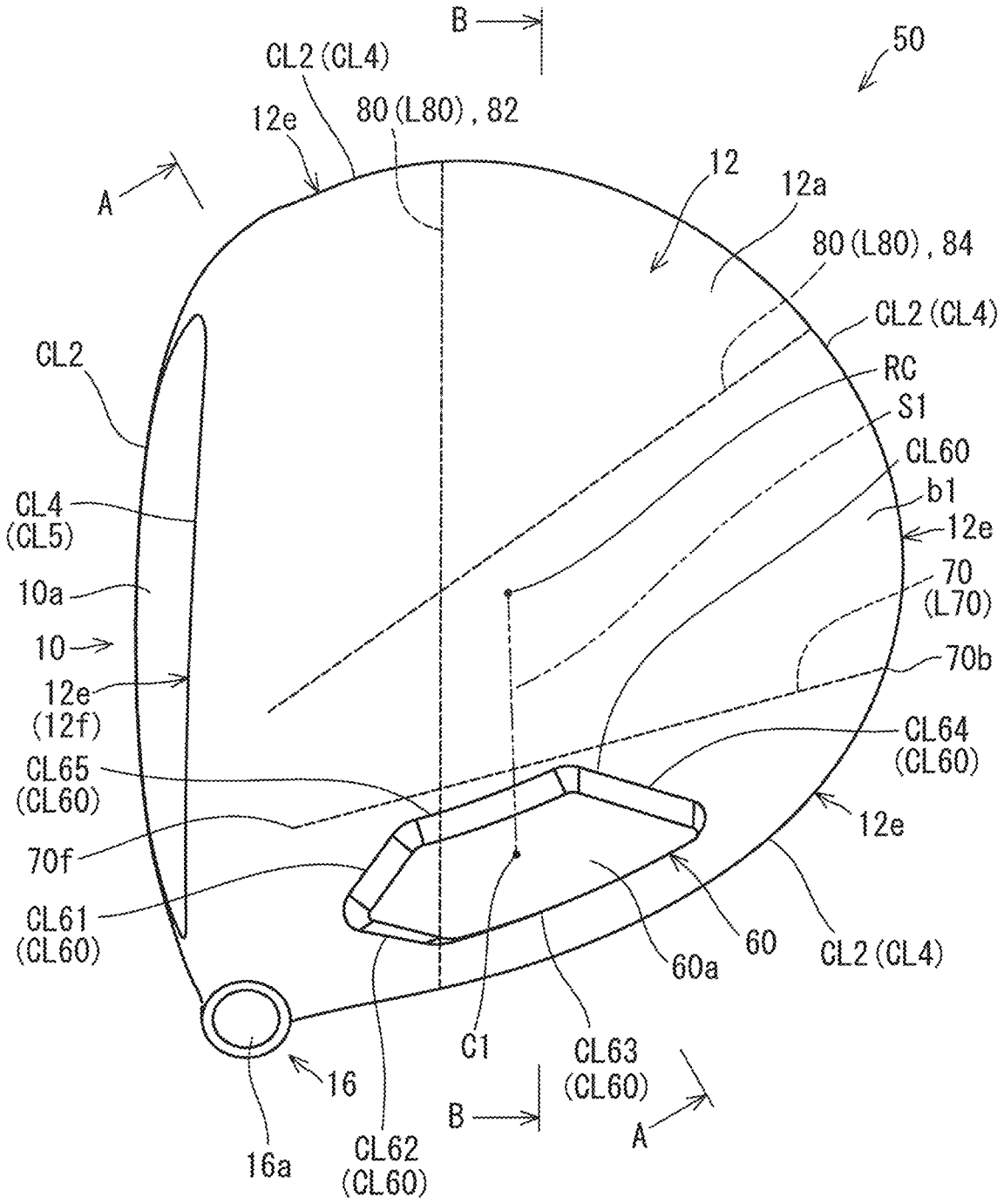
FIG. 16 is a plan view of a head according to a second embodiment.
Figure 17:
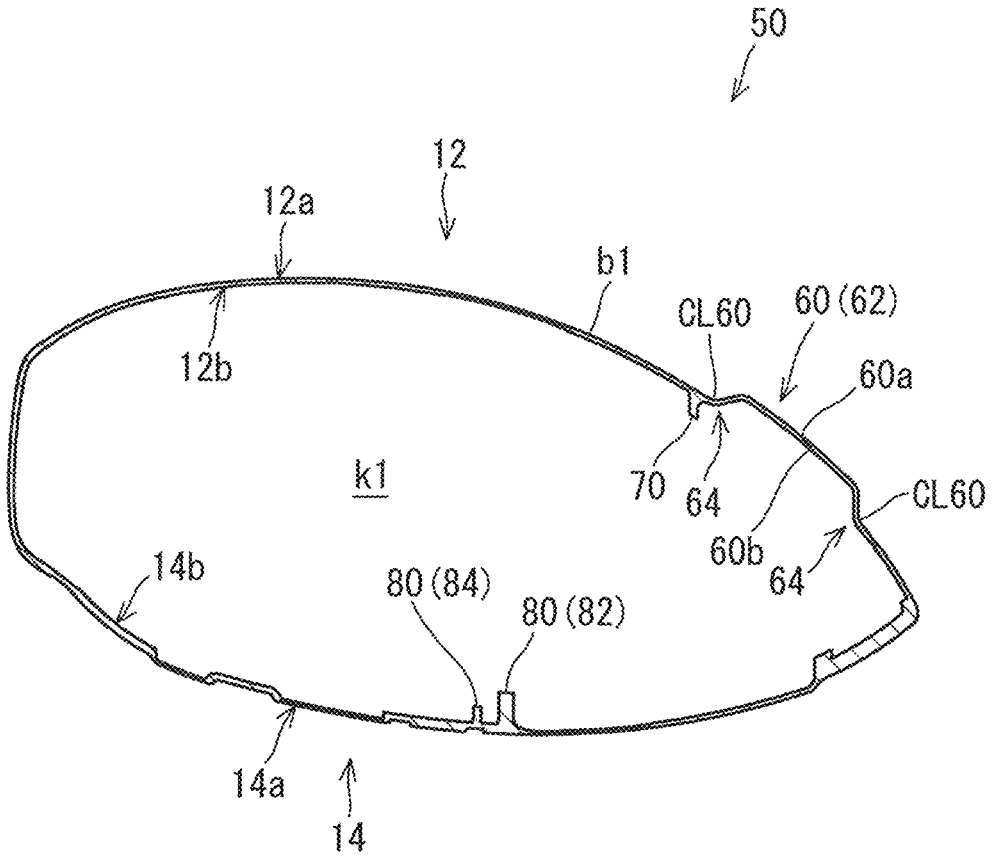
FIG. 17 is a cross-sectional view taken along line A-A in FIG. 16.
Figure 18:
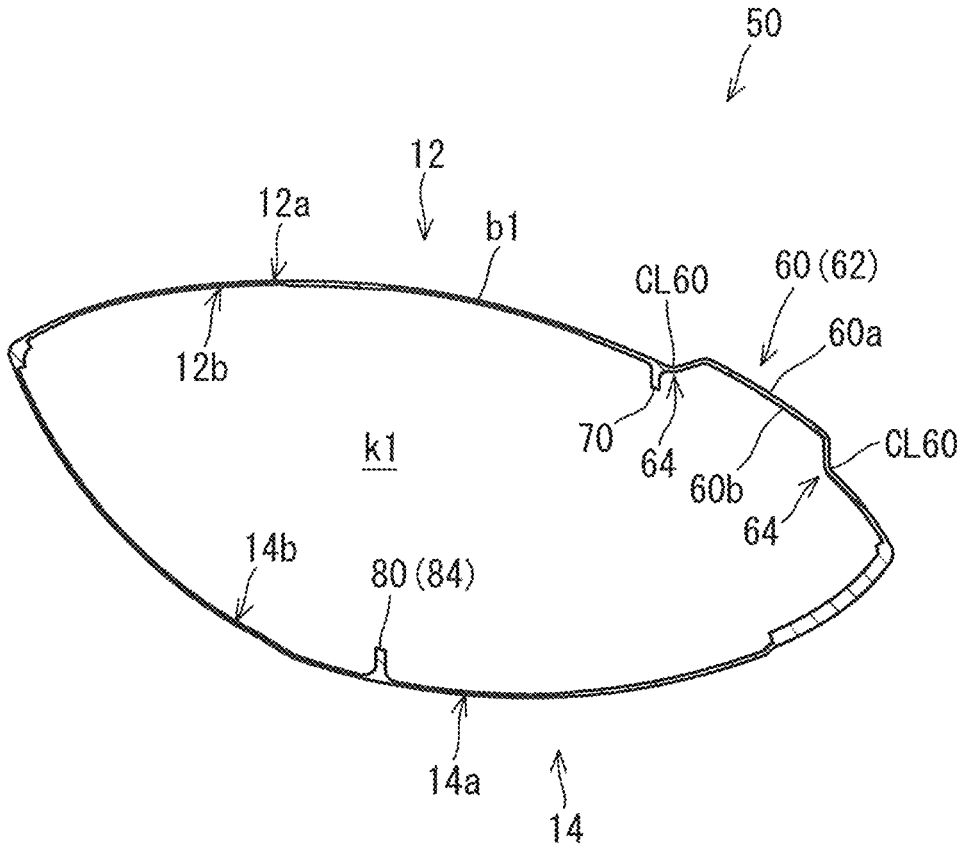
FIG. 18 is a cross-sectional view taken along line B-B in FIG. 16.
Figure 19:
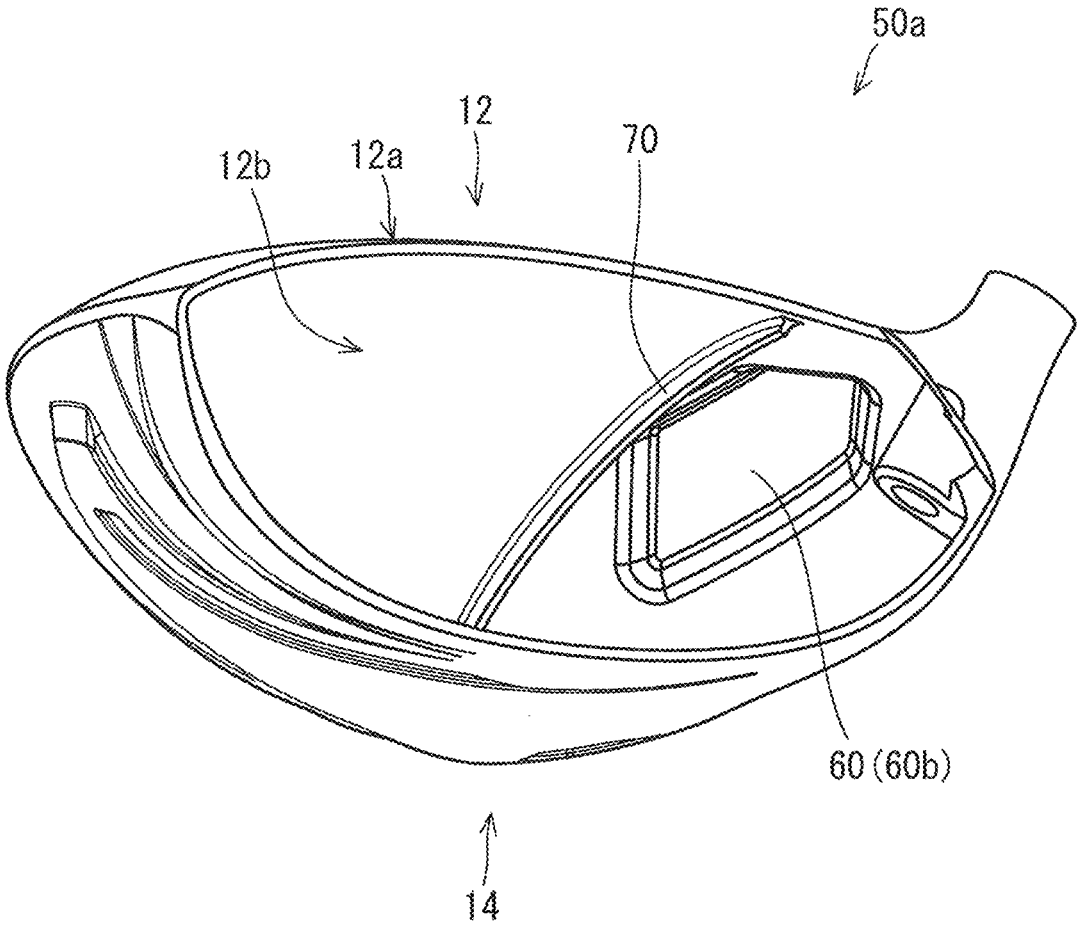
FIG. 19 is a perspective view of a head body of the head according to the second embodiment.

FIG. 16 is a plan view of a head 50 according to a second embodiment. FIG. 17 is a cross-sectional view taken along line A-A in FIG. 16. FIG. 18 is a cross-sectional view taken along line B-B in FIG. 16. FIG. 19 is a perspective view of a head body 50*a* of the head 50. In the head 50, a face member (not shown in the drawings) and the head body 50*a* are joined (welded) to each other. In FIG. 19, the face member is absent, and thus the inside of the head 50 is viewable.

The head 50 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a* and a crown inner surface 12*b*. The crown outer surface 12*a* includes a crown base surface b1 that is a convex curved surface and extends continuously with no step. The sole portion 14 forms a sole outer surface 14*a* and a sole inner surface 14*b*. The hosel portion 16 has a shaft hole 16*a*.

The crown portion 12 includes a crown atypically-shaped portion 60. The crown atypically-shaped portion 60 is hollow. The crown atypically-shaped portion 60 forms an outer surface projection 60*a* on the crown outer surface 12*a* while forming an inner surface recess 60*b* on the crown inner surface 12*b*. The inner surface recess 60*b* is recessed to correspond to the outer surface projection 60*a*. The crown atypically-shaped portion 60 forms a projection on the crown portion 12 when viewed from outside the head 50. The crown atypically-shaped portion 60 is a crown projection 62. The entirety of the crown atypically-shaped portion 60 is located on the heel side relative to the face center.

The crown atypically-shaped portion 60 has a contour line CL60. The contour line CL60 is a boundary line between the crown base surface b1 and the crown atypically-shaped portion 60. In the plan view (planar view) of the head 50, the crown atypically-shaped portion 60 has a substantially pentagonal shape. The substantially pentagonal shape is formed by the contour line CL60.

The contour line CL60 of the crown atypically-shaped portion 60 has a first side CL61, a second side CL62, a third side CL63, a fourth side CL64, and a fifth side CL65.

As shown in FIG. 17 and FIG. 18, in the crown portion 12, a bent portion 64 is formed along the contour line CL60 of the crown atypically-shaped portion 60. The wall thickness of the crown atypically-shaped portion 60 is substantially the same as the wall thickness of the crown portion 12 in the vicinity of the crown atypically-shaped portion 60. Since the inner surface recess 60*b* is formed on the reverse side of the outer surface projection 60*a*, the bent portion 64 is formed.

As shown with a dashed line in FIG. 16, the crown portion 12 includes a rib (crown rib) 70. The crown rib 70 is schematically illustrated by indicating only its rib center line L70. The crown rib 70 is provided on the crown inner surface 12*b*. The crown portion 12 including the crown rib 70 is integrally formed as a single piece member.

The crown rib 70 is provided at a position different from the position of the crown atypically-shaped portion 60. The crown rib 70 is located apart from the crown atypically-shaped portion 60. The crown rib 70 does not intersect the crown atypically-shaped portion 60.

As shown with dashed lines in FIG. 16, the sole portion 14 of the head 50 includes a rib 80. The rib 80 is provided on the sole inner surface 14*b*. The rib 80 is also referred to as a sole rib. The sole rib 80 is schematically illustrated by indicating only its rib center line L80. The sole rib 80 includes a first sole rib 82 and a second sole rib 84. The first sole rib 82 and the second sole rib 84 intersect each other.

As shown in FIG. 16, the crown rib 70 is positioned on the crown center side relative to the center C1 of the crown atypically-shaped portion 60. Further, the crown rib 70 is positioned on the crown center side relative to the entirety of the crown atypically-shaped portion 60. The contour line CL60 of the crown atypically-shaped portion 60 includes a specific side CL65 that is positioned on the crown center side relative to the center C1 of the crown atypically-shaped portion 60. The crown rib 70 extends substantially parallel to the specific side CL65. A first end (back-side end) 70*b* of the crown rib 70 is located in the outer edge portion 12*e* of the crown portion 12. A second end (face-side end) 70*f* of the crown rib 70 is not located in the outer edge portion 12*e*. The face-side end 70*f* is located on the back side relative to the outer edge portion 12*f*. In the head 50, the entirety of the crown atypically-shaped portion 60 is disposed in the region extending from the contour line CL4 of the crown portion 12 to the position 40 mm apart from the contour line CL4.

Figure 20:
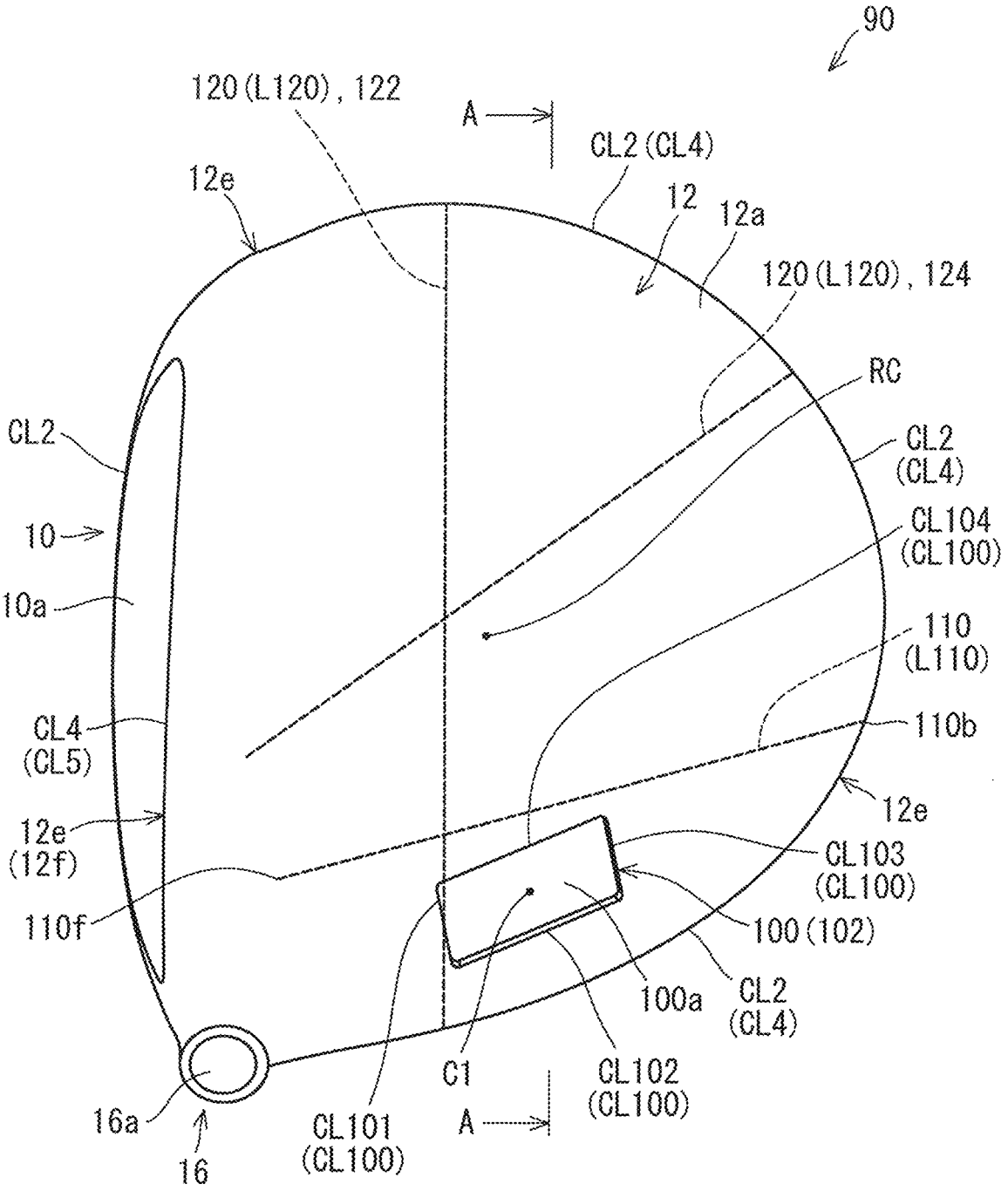
FIG. 20 is a plan view of a head according to a third embodiment.
Figure 21:
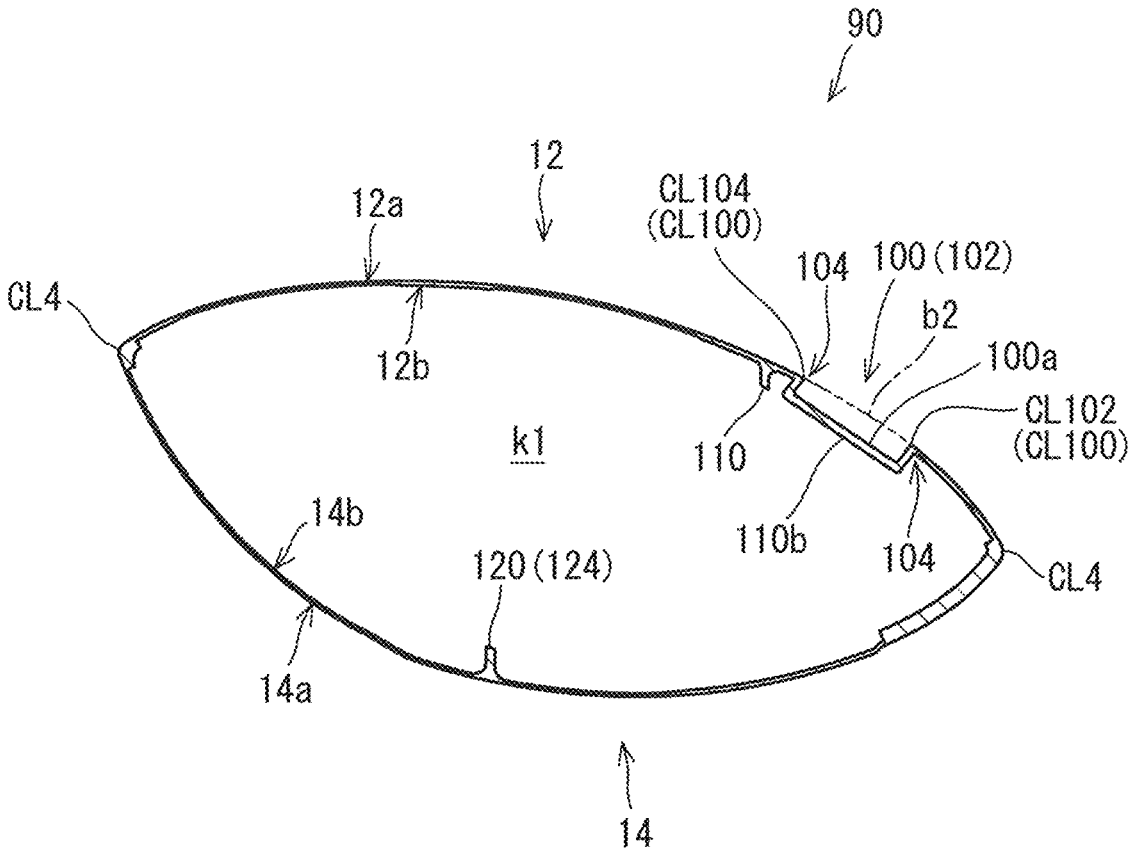
FIG. 21 is a cross-sectional view taken along line A-A in FIG. 20.

FIG. 20 is a plan view of a head 90 according to a third embodiment. FIG. 21 is a cross-sectional view taken along line A-A in FIG. 20.

The head 90 includes a face portion 10, a crown portion 12, a sole portion 14, and a hosel portion 16. The face portion 10 includes a striking face 10*a*. The striking face 10*a* is the outer surface of the face portion 10. The crown portion 12 forms a crown outer surface 12*a* and a crown inner surface 12*b*. The crown outer surface 12*a* includes a crown base surface b1 that is a convex curved surface and extends continuously with no step. The sole portion 14 forms a sole outer surface 14*a* and a sole inner surface 14*b*. The hosel portion 16 has a shaft hole 16*a*. The crown inner surface 12*b* and the sole inner surface 14*b* face a hollow portion k1.

The crown portion 12 includes a crown atypically-shaped portion 100. The crown atypically-shaped portion 100 is hollow. Unlike the crown atypically-shaped portion 20 or the crown atypically-shaped portion 60, the crown atypically-shaped portion 100 is a crown recess 102. The crown atypically-shaped portion 100 forms a recess (outer surface recess) 100*a* on the crown outer surface 12*a* while forming a projection (inner surface projection) 100*b* on the crown inner surface 12*b*. The inner surface projection 100*b* protrudes to correspond to the outer surface recess 100*a*. The crown atypically-shaped portion 100 forms a recess on the crown portion 12 when viewed from outside the head 90. The entirety of the crown atypically-shaped portion 100 is located on the heel side relative to the face center. The head 90 is the same as the head 50 except for the shape of the crown atypically-shaped portion.

The outer surface recess 100*a* has a portion located on the inner side (inner side of the head 90) relative to the virtually extended surface b2.

The crown recess 102 can be used as a receiving portion to which an additional member such as a badge is attached. The additional member such as badge can be attached to the outer surface recess 100*a*. The fixability of the additional member is enhanced by physical engagement with the outer surface recess 100*a*. By forming a flat surface portion on the bottom surface of the outer surface recess 100*a*, attachability (adhesivity) of the additional member can be improved. Further, the presence of the outer surface recess 100*a* can suppress the height of the additional member from the crown outer surface 12*a*. The material of the additional member such as badge can be a resin, a metal, a ceramic, or any combination thereof.

The crown atypically-shaped portion 100 has a contour line CL100. In the planar view, the crown atypically-shaped portion 100 has a substantially rectangular shape. The substantially rectangular shape is formed by the contour line CL100.

The crown atypically-shaped portion 100 (contour line CL100) has a first side CL101, a second side CL102, a third side CL103, and a fourth side CL104.

As shown in FIG. 21, in the crown portion 12, a bent portion 104 is formed along the contour line CL100 of the crown atypically-shaped portion 100. The wall thickness of the crown atypically-shaped portion 100 is substantially the same as the wall thickness of the crown portion 12 in the vicinity of the crown atypically-shaped portion 100. Since the inner surface projection 100*b* is formed on the reverse side of the outer surface recess 100*a*, the bent portion 104 is formed.

As shown with a dushed line in FIG. 20, the crown portion 12 includes a rib (crown rib) 110. The crown rib 110 is schematically illustrated by indicating only its rib center line L110. The crown rib 110 is provided on the crown inner surface 12*b*. The crown portion 12 including the crown rib 110 is integrally formed as a single piece member.

The crown rib 110 is provided at a position different from the position of the crown atypically-shaped portion 100. The crown rib 110 is located apart from the crown atypically-shaped portion 100. The crown rib 110 does not intersect the crown atypically-shaped portion 100. The crown rib 110 is located between the crown atypically-shaped portion 100 and the crown center RC.

As shown with dushed lines in FIG. 20, the sole portion 14 of the head 90 includes a rib (sole rib) 120. The sole rib 120 is schematically illustrated by indicating only its rib center line L120. The rib (sole rib) 120 is provided on the sole inner surface 14*b*. The sole rib 120 includes a first sole rib 122 and a second sole rib 124. The first sole rib 122 and the second sole rib 124 intersect each other. As shown in FIG. 21, the sole rib 120 has a height higher than that of the crown rib 110.

As shown in FIG. 20, the crown rib 110 is positioned on the crown center side relative to the center C1 of the crown atypically-shaped portion 100. The crown rib 110 is positioned on the crown center side relative to the entirety of the crown atypically-shaped portion 100. The contour line CL100 of the crown atypically-shaped portion 100 includes a specific side CL104 positioned on the crown center side relative to the center C1 of the crown atypically-shaped portion 100. The crown rib 110 extends substantially parallel to the specific side CL104. A first end (back-side end) 110*b* of the crown rib 110 is located in the outer edge portion 12*e* of the crown portion 12. A second end (face-side end) 110*f* of the crown rib 110 is not located in the outer edge portion 12*e*. The face-side end 110*f* is located on the back side relative to the outer edge portion 12*f*. In the head 90, the entirety of the crown atypically-shaped portion 100 is disposed in the region extending from the contour line CL4 of the crown portion 12 to the position 40 mm apart from the contour line CL4.

Figure 22:
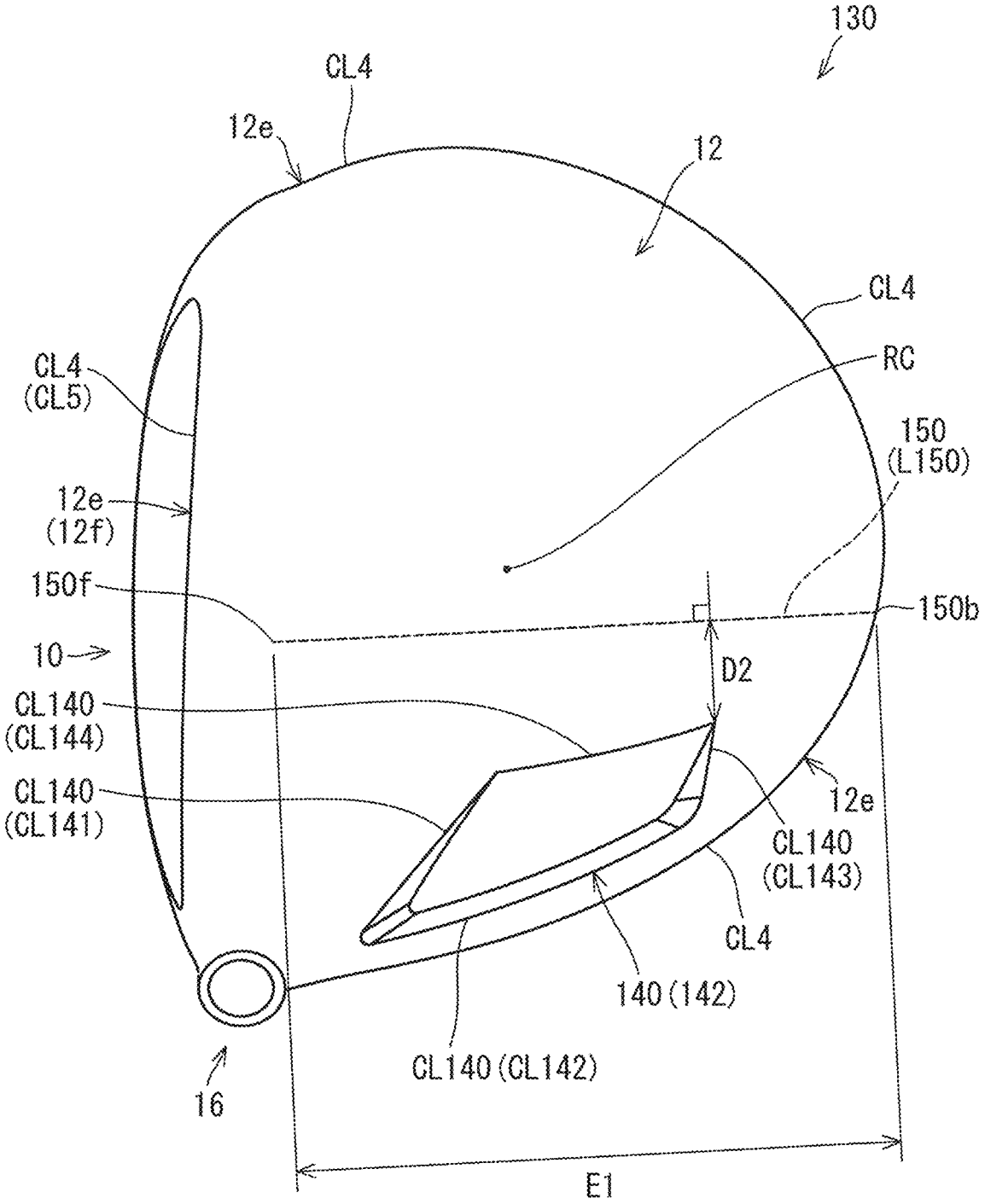
FIG. 22 is a plan view of a head according to a fourth embodiment.

FIG. 22 is a plan view of a head 130 according to a fourth embodiment. The head 130 is the same as the above-described head 4 except that the crown atypically-shaped portion and the crown rib is replaced. The head 130 includes a face portion 10, a crown portion 12, a sole portion (not shown in the drawing), and a hosel portion 16.

The crown portion 12 includes a crown atypically-shaped portion 140. The crown atypically-shaped portion 140 is a crown projection 142. The crown atypically-shaped portion 140 has a contour line CL140. The contour line CL140 includes a plurality of (four) sides. The contour line CL140 has a first side CL141, a second side CL142, a third side CL143, and a fourth side CL144. The contour line CL140 includes a specific side CL144 positioned on the crown center side relative to the center of the crown atypically-shaped portion 140.

The crown portion 12 includes a crown rib 150. The crown rib 150 is provided on the inner surface of the crown portion 12. The crown rib 150 is schematically illustrated by indicating only its rib center line L150 with dushed line. The crown rib 150 is provided at a position different from the position of the crown atypically-shaped portion 140. The crown rib 150 is located apart from the crown atypically-shaped portion 140. The crown rib 150 does not intersect the crown atypically-shaped portion 140. The crown rib 150 is located between the crown atypically-shaped portion 140 and the crown center RC.

The crown rib 150 is positioned on the crown center side relative to the center of the crown atypically-shaped portion 140. The crown rib 150 is positioned on the crown center side relative to the entirety of the crown atypically-shaped portion 140. The crown rib 150 extends substantially parallel to the specific side CL144. A first end 150*b* of the crown rib 150 is located in the outer edge portion 12*e* of the crown portion 12. A second end 150*f* of the crown rib 150 is not located in the outer edge portion 12*e*. In the head 130, the entirety of the crown atypically-shaped portion 140 is disposed in the region extending from the contour line CL4 of the crown portion 12 to the position 40 mm apart from the contour line CL4.

Figure 23:
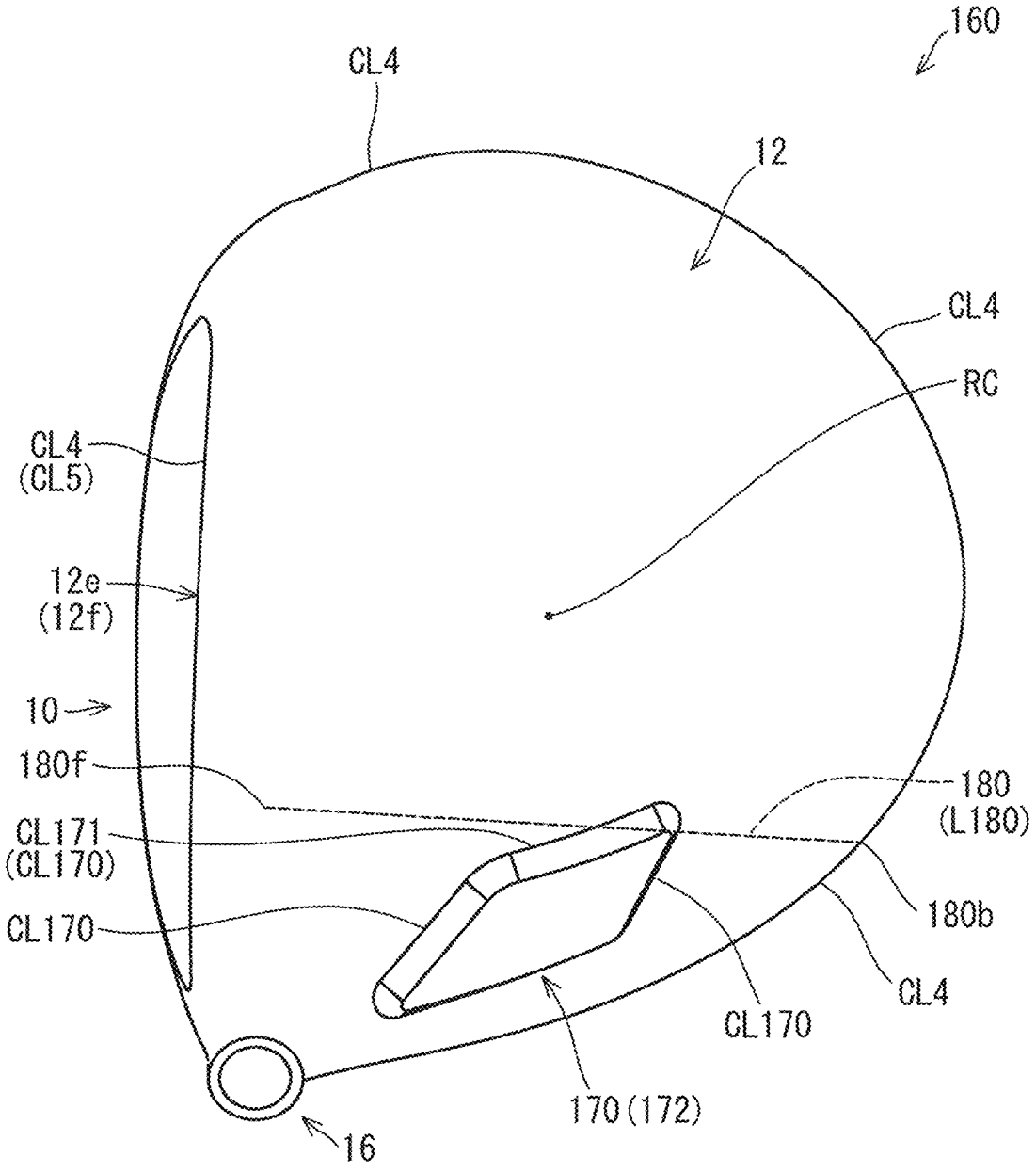
FIG. 23 is a plan view of a head according to a fifth embodiment.

FIG. 23 is a plan view of a head 160 according to a fifth embodiment. The head 160 is the same as the above-described head 4 except that the crown atypically-shaped portion and the crown rib is replaced. The head 160 includes a face portion 10, a crown portion 12, a sole portion (not shown in the drawing), and a hosel portion 16.

The crown portion 12 includes a crown atypically-shaped portion 170. The crown atypically-shaped portion 170 is a crown projection 172. The crown atypically-shaped portion 170 has a contour line CL170. The contour line CL170 includes a plurality of (four) sides. The contour line CL170 includes a specific side CL171 positioned on the crown center side relative to the center of the crown atypically-shaped portion 170.

The crown portion 12 includes a crown rib 180. The crown rib 180 is provided on the inner surface of the crown portion 12. The crown rib 180 is schematically illustrated by indicating only its rib center line L180 with dushed line. The crown rib 180 includes a portion located on the inner surface of the crown atypically-shaped portion 170. That is, the crown rib 180 intersects the crown atypically-shaped portion 170. The crown rib 180 intersects the specific side CL171. The crown rib 180 is located between the center of the crown atypically-shaped portion 170 and the crown center RC.

The crown rib 180 is positioned on the crown center side relative to the center of the crown atypically-shaped portion 170. However, the crown rib 180 is not positioned on the crown center side relative to the entirety of the crown atypically-shaped portion 170. The crown rib 180 is not substantially parallel to the specific side CL171. A first end 180*b* of the crown rib 180 is located in the outer edge portion 12*e* of the crown portion 12. A second end 180*f* of the crown rib 180 is not located in the outer edge portion 12*e*. In the head 160, the entirety of the crown atypically-shaped portion 170 is disposed in the region extending from the contour line CL4 of the crown portion 12 to the position 40 mm apart from the contour line CL4.

Figure 24:
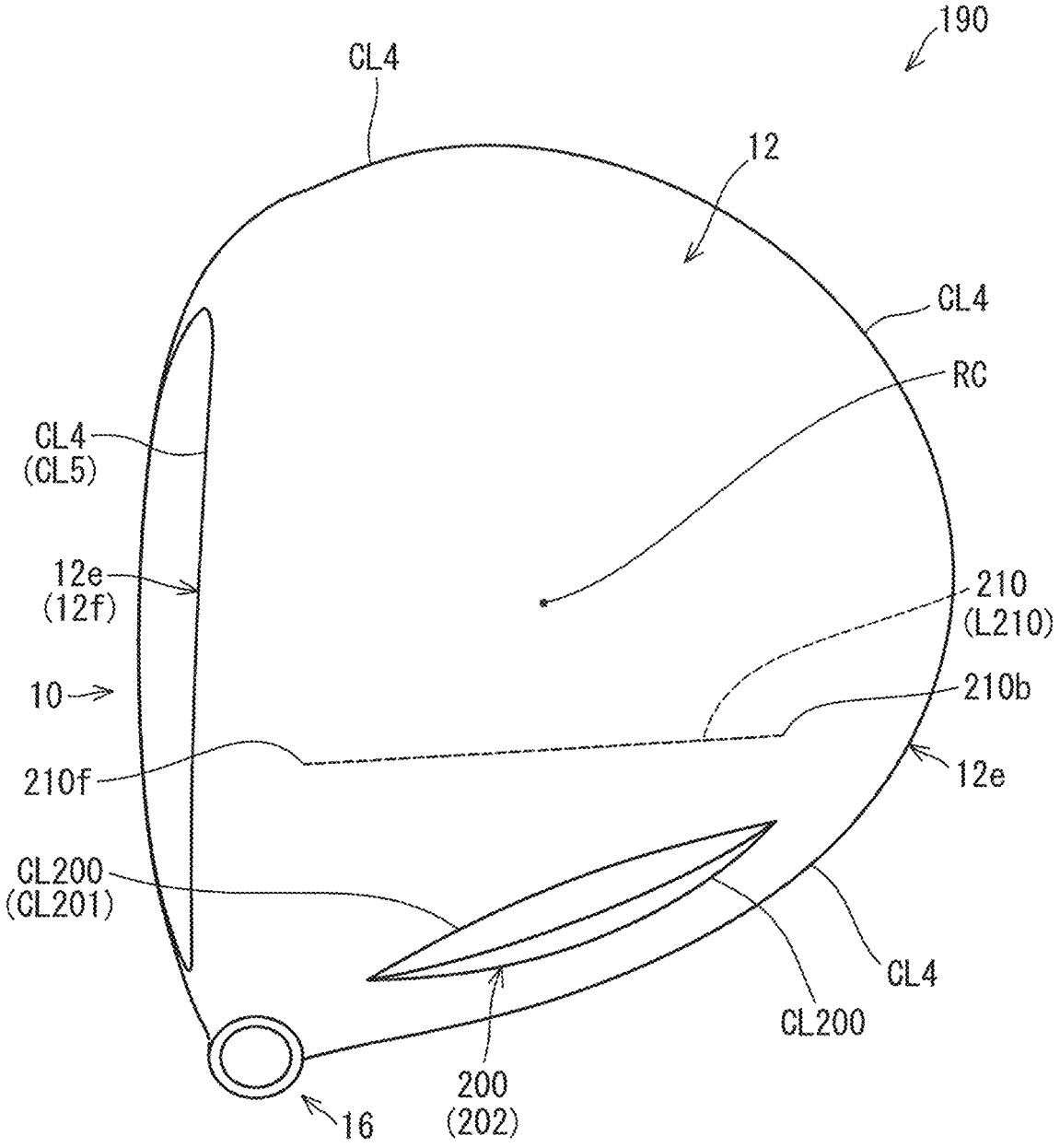
FIG. 24 is a plan view of a head according to a sixth embodiment.

FIG. 24 is a plan view of a head 190 according to a sixth embodiment. The head 190 is the same as the above-described head 4 except that the crown atypically-shaped portion and the crown rib is replaced. The head 190 includes a face portion 10, a crown portion 12, a sole portion (not shown in the drawing), and a hosel portion 16.

The crown portion 12 includes a crown atypically-shaped portion 200. The crown atypically-shaped portion 200 is a crown projection 202. The crown atypically-shaped portion 200 has a contour line CL200. The contour line CL200 has a specific side CL201.

The crown portion 12 includes a crown rib 210. The crown rib 210 is provided on the inner surface of the crown portion 12. The crown rib 210 is schematically illustrated by indicating only its rib center line L210 with dushed line. The crown rib 210 is provided at a position different from the position of the crown atypically-shaped portion 200. The crown rib 210 is located apart from the crown atypically-shaped portion 200. The crown rib 210 does not intersect the crown atypically-shaped portion 200. The crown rib 210 is located between the crown atypically-shaped portion 200 and the crown center RC.

The crown rib 210 is positioned on the crown center side relative to the center of the crown atypically-shaped portion 200. The crown rib 210 is positioned on the crown center side relative to the entirety of the crown atypically-shaped portion 200. A first end 210*b* of the crown rib 210 is not located in the outer edge portion 12*e* of the crown portion 12. A second end 210*f* of the crown rib 210 is not located in the outer edge portion 12*e*, either. In the head 190, the entirety of the crown atypically-shaped portion 200 is disposed in the region extending from the contour line CL4 of the crown portion 12 to the position 40 mm apart from the contour line CL4.

Figure 25:
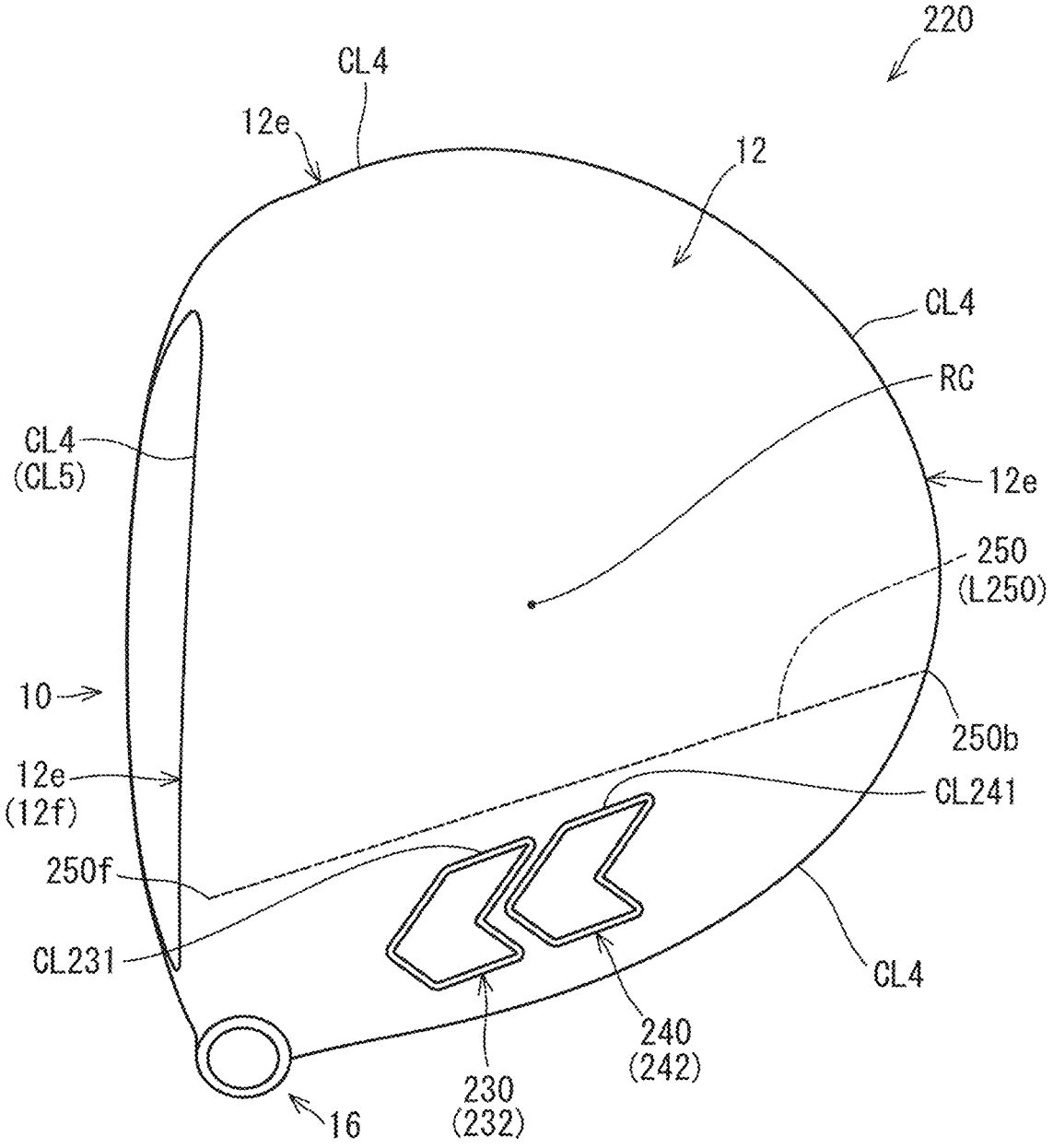
FIG. 25 is a plan view of a head according to a seventh embodiment.

FIG. 25 is a plan view of a head 220 according to a seventh embodiment. The head 220 is the same as the above-described head 4 except that the crown atypically-shaped portion and the crown rib is replaced. The head 220 includes a face portion 10, a crown portion 12, a sole portion (not shown in the drawing), and a hosel portion 16.

The crown portion 12 includes a plurality of (two) crown atypically-shaped portions. The crown portion 12 includes a first crown atypically-shaped portion 230 and a second crown atypically-shaped portion 240. The crown atypically-shaped portion 230 is a crown projection 232. The crown atypically-shaped portion 240 is a crown projection 242. The crown atypically-shaped portion 230 is located on the face side of the crown atypically-shaped portion 240.

The contour line of the crown atypically-shaped portion 230 has a specific side CL231 that is positioned on the crown center side relative to the center of the crown atypically-shaped portion 230. The contour line of the crown atypically-shaped portion 240 has a specific side CL241 that is positioned on the crown center side relative to the center of the crown atypically-shaped portion 240.

The crown portion 12 includes a crown rib 250. The crown rib 250 is provided on the inner surface of the crown portion 12. The crown rib 250 is schematically illustrated by indicating only its rib center line L250 with dushed line. The crown rib 250 is located apart from the crown atypically-shaped portion 230. The crown rib 250 is located between the crown atypically-shaped portion 230 and the crown center RC. The crown rib 250 is located apart from the crown atypically-shaped portion 240. The crown rib 250 is located between the crown atypically-shaped portion 240 and the crown center RC.

The crown rib 250 is positioned on the crown center side relative to the center of the crown atypically-shaped portion 230. The crown rib 250 is positioned on the crown center side relative to the center of the crown atypically-shaped portion 240. The crown rib 250 is positioned on the crown center side relative to the entirety of the crown atypically-shaped portion 230. The crown rib 250 is positioned on the crown center side relative to the entirety of the crown atypically-shaped portion 240.

The crown rib 250 extends substantially parallel to the specific side CL231. The crown rib 250 extends substantially parallel to the specific side CL241. A first end 250*b* of the crown rib 250 is located in the outer edge portion 12*e* of the crown portion 12. A second end 250*f* of the crown rib 250 is also located in the outer edge portion 12*e*. The entirety of the crown atypically-shaped portion 230 is disposed in the region extending from the contour line CL4 of the crown portion 12 to the position 40 mm apart from the contour line CL4. The entirety of the crown atypically-shaped portion 240 is disposed in the region extending from the contour line CL4 of the crown portion 12 to the position 40 mm apart from the contour line CL4. The entirety of all of the plurality of crown atypically-shaped portions 230 and 240 is disposed in the region extending from the contour line CL4 of the crown portion 12 to the position 40 mm apart from the contour line CL4.

Figure 26:
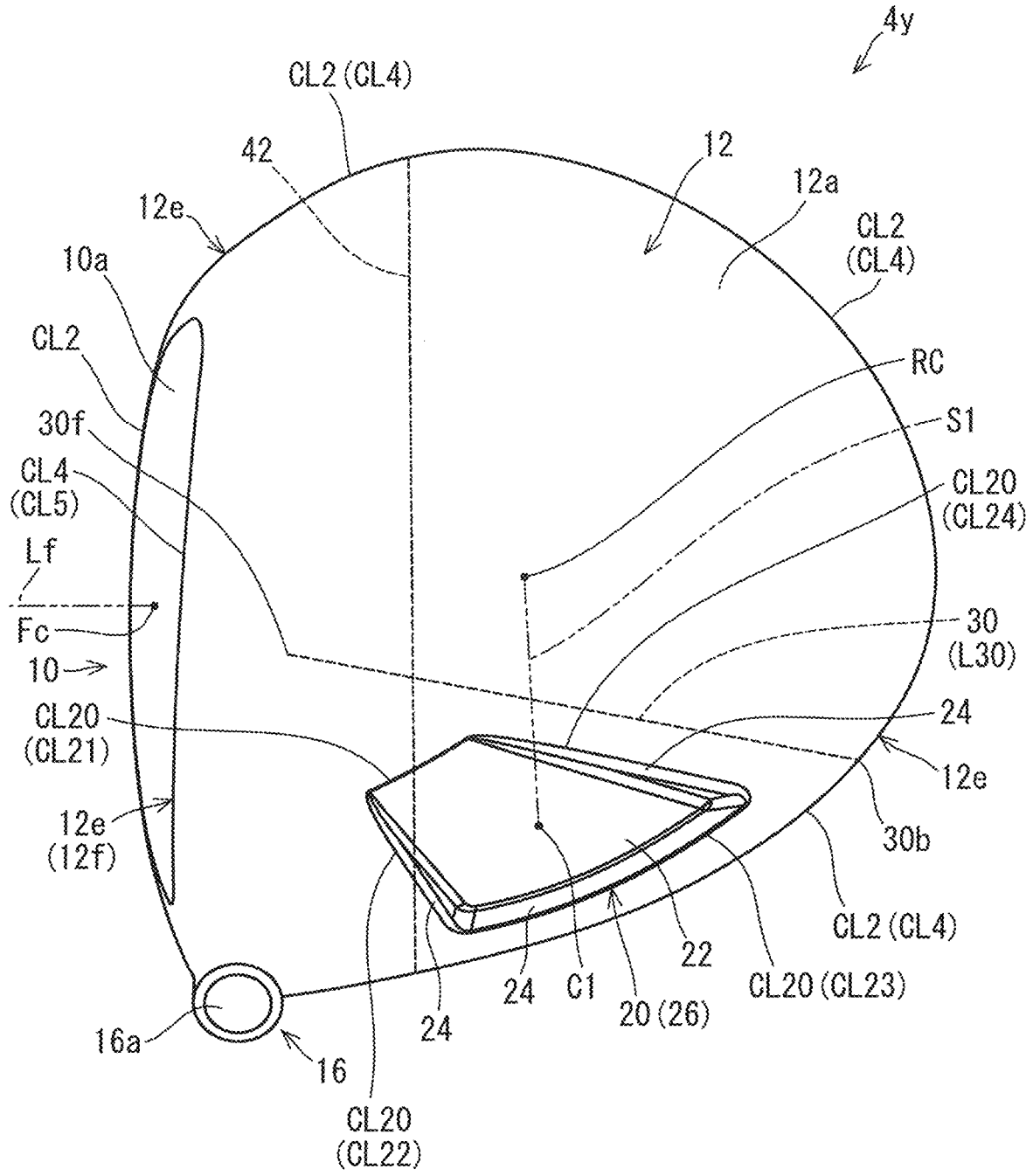
FIG. 26 is a plan view of a head according to an eighth embodiment as viewed from the crown side.

FIG. 26 is a plan view of a head 4*y* according to an eighth embodiment as viewed from the crown side. The head 4*y* includes a crown rib 30 and a sole rib 42. The head 4*y* is the same as the head 4 of the first embodiment except that the second sole rib 44 is removed from the head 4 of the first embodiment. In the head 4*y*, the number of the sole rib is one. In the planar view, the sole rib 42 intersects the crown rib 30. In the head 4*y*, a portion having the maximum amplitude in the primary vibration mode is located in the crown portion 12.

Figure 27:
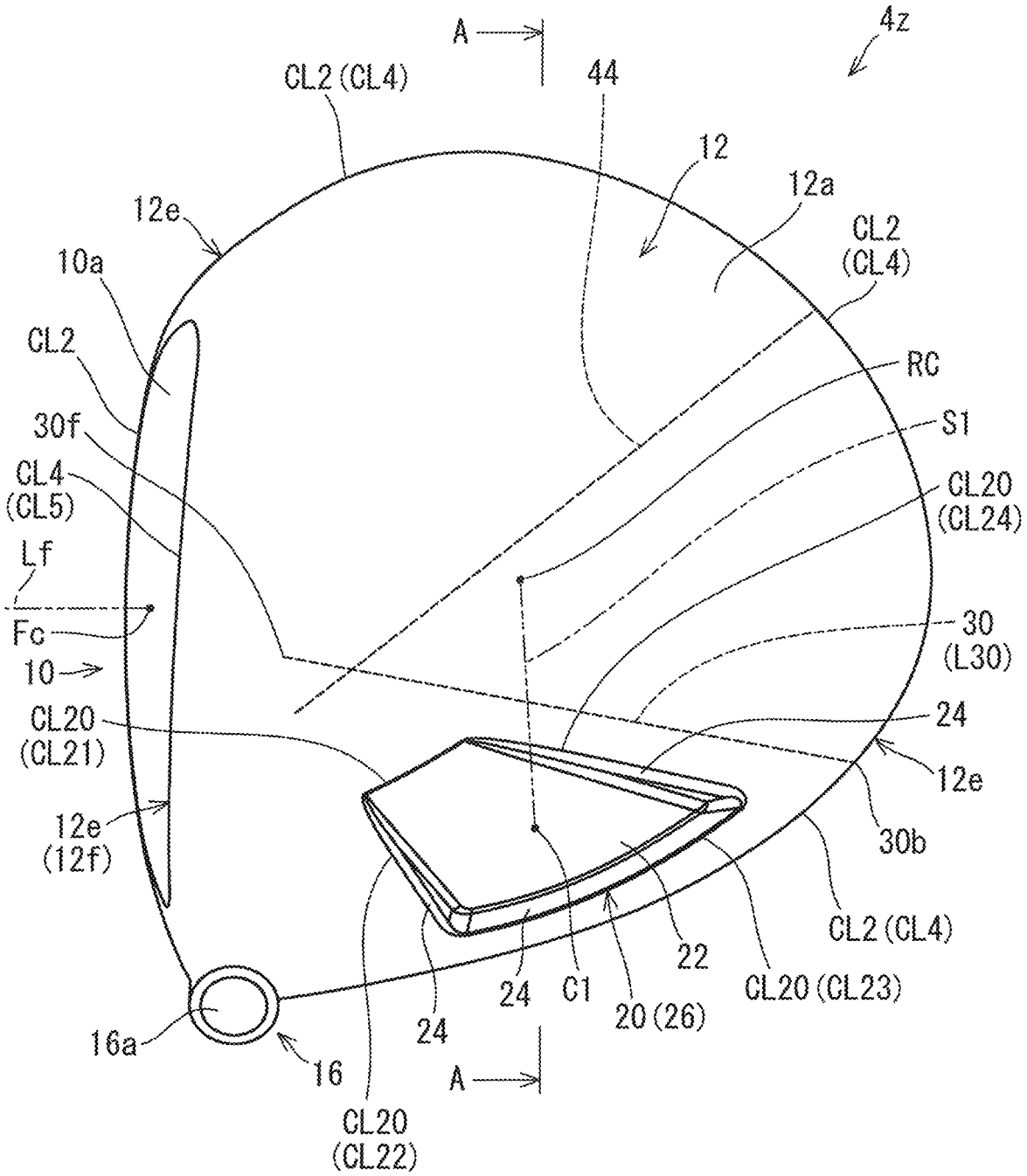
FIG. 27 is a plan view of a head according to a ninth embodiment as viewed from the crown side.
Figure 28:
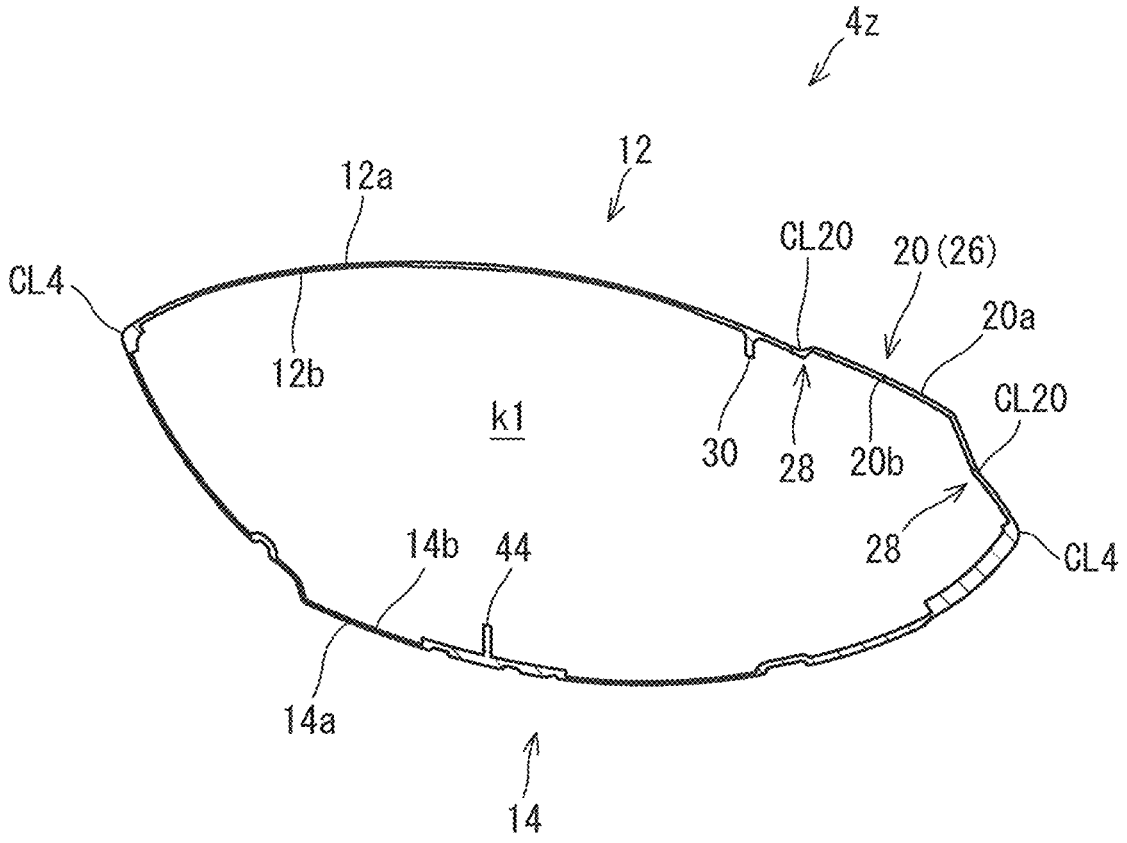
FIG. 28 is a cross-sectional view taken along line A-A in FIG. 27.

FIG. 27 is a plan view of a head 4*z* according to a ninth embodiment as viewed from the crown side. FIG. 28 is a cross-sectional view taken along line A-A in FIG. 27. The head 4*z* includes a crown rib 30 and a sole rib 44. The head 4*z* is the same as the head 4 of the first embodiment except that the first sole rib 42 is removed from the head 4 of the first embodiment. In the head 4*z*, the number of the sole rib is one. In the planar view, the sole rib 44 intersects the crown rib 30. In the head 4*z*, a portion having the maximum amplitude in the primary vibration mode is located in the crown portion 12. As shown in FIG. 28, the sole rib 44 has a height higher than that of the crown rib 30.

Figure 29:
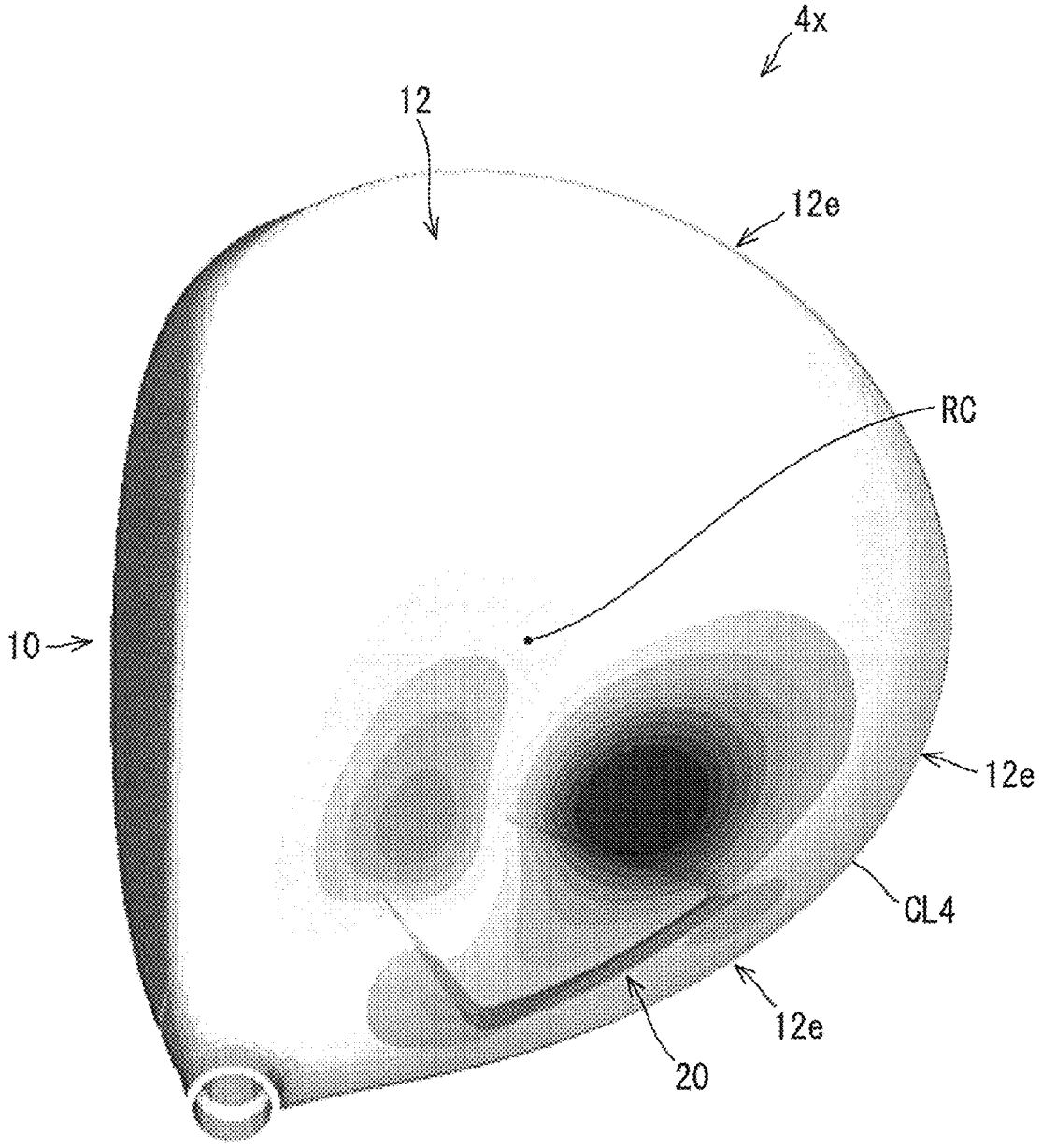
FIG. 29 is a simulation image showing a primary vibration mode of a head in which a crown rib is removed from the head of the first embodiment.

FIG. 29 is a simulation image showing a vibration mode of a head 4*x* in which the crown rib 30 is removed from the head 4 of the first embodiment. FIG. 29 shows a primary vibration mode. In this image, the relative magnitude of amplitude of vibration with respect to the maximum amplitude of vibration is indicated by contour lines. In this image, the lower (darker) the brightness is, the larger the amplitude of vibration is.

Figure 30:
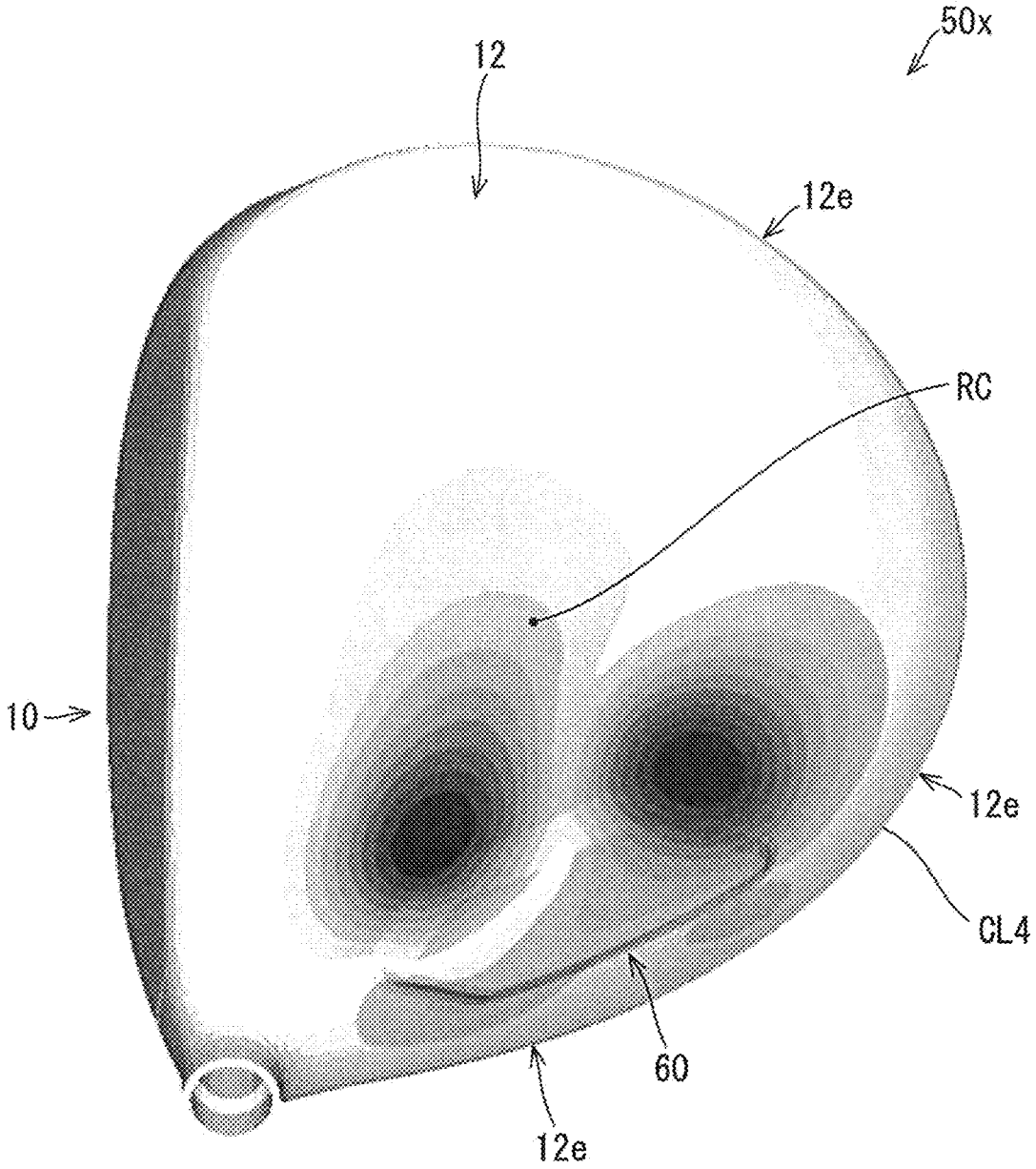
FIG. 30 is a simulation image showing a primary vibration mode of a head in which a crown rib is removed from the head of the second embodiment.

FIG. 30 is a simulation image showing a vibration mode of a head 50*x* in which the crown rib 70 is removed from the head 50 of the second embodiment. FIG. 30 shows a primary vibration mode. In this image, the relative magnitude of amplitude of vibration with respect to the maximum amplitude of vibration is indicated by contour lines. In this image, the lower (darker) the brightness is, the larger the amplitude of vibration is.

The vibration mode means the shape of vibration obtained by an eigenvalue analysis (modal analysis) of the head. The vibration mode is also referred to as a characteristic mode shape. The vibration mode is determined for each natural frequency. A vibration mode when the natural frequency is at the smallest value is the primary vibration mode. The vibration modes such as the primary vibration mode, the secondary vibration mode, and the tertiary vibration mode are determined in ascending order of the natural frequency. The eigenvalue analysis of a head is performed by simulation.

In this simulation, the finite element method is used. In this finite element method, three-dimensional data (calculation model) of a head is mesh-divided. This mesh division can be made by a commercially available pre-processor (such as HyperMesh). In addition, a longitudinal elastic modulus, a density, and a Poisson's ratio are used as the physical property values of the head material.

In the eigenvalue analysis, natural frequencies of the head and vibration modes for respective natural frequencies are obtained. As a software for the eigenvalue analysis, "Nastran" produced by MSC software Corporation can be used. The constraint condition is set to a free support condition. By this eigenvalue analysis, a plurality of natural frequencies and vibration modes for respective natural frequencies are obtained.

As shown in FIG. 29 and FIG. 30, the inventor of the present disclosure found that vibration having a large amplitude occurs on and near the crown atypically-shaped portion. The inventor has also found that the amplitude of vibration is particularly large on the crown center side of the crown atypically-shaped portion. It has been found that the crown portion 12 tends to vibrate at a low frequency because of the presence of the crown atypically-shaped portion. Accordingly, it is found that the presence of the crown atypically-shaped portion lowers the pitch of sound at impact. It is considered that the bending of the bent portion causes the low-frequency vibration. It is considered that the vibration is generated in a state where the first starting point of the vibration is positioned at the bent portion and the second starting point of the vibration is positioned on the crown center side of the bent portion.

As shown in FIG. 29 and FIG. 30, it has been found that a portion having a large amplitude of vibration is located on and near the crown atypically-shaped portion and on the crown center side of the crown atypically-shaped portion. Further, it has been found that the vibration extends to the vicinity of the crown center RC. In the outer edge portion 12*e*, the rigidity of the crown portion 12 is high. Accordingly, it is considered that vibration is hardly generated in a region that is located on the outer edge portion 12*e* side relative to the crown atypically-shaped portion. On the other hand, a region that is located on the crown center RC side relative to the crown atypically-shaped portion has a lower rigidity than the rigidity of the outer edge portion 12*e*. For this reason, it is considered that vibration having a large amplitude is generated on the crown center side of the crown atypically-shaped portion.

The crown rib 30 of the head 4 suppresses the occurrence of the low-frequency vibration which is otherwise caused by the crown atypically-shaped portion 20. The crown rib 30 is disposed in a portion having a large amplitude of vibration in the head 4*x*. In this case, the above-mentioned vibration suppression effect is large. The crown rib 30 increases the primary natural frequency and makes the frequency of sound at impact higher. The primary natural frequency of the head 4*x* was 3296 Hz. On the other hand, the primary natural frequency of the head 4 provided with the crown rib 30 was 3783 Hz.

The same applies to the head 50. The crown rib 70 of the head 50 suppresses the occurrence of the low-frequency vibration that is otherwise caused by the crown atypically-shaped portion 60. The crown rib 70 is disposed in a portion having a large amplitude of vibration in the head 50*x*. In this case, the above-mentioned vibration suppression effect is large. The crown rib 70 increases the primary natural frequency and makes the frequency of sound at impact higher. The primary natural frequency of the head 50*x* was 3053 Hz. On the other hand, the primary natural frequency of the head 50 provided with the crown rib 70 was 3436 Hz.

A portion located on the crown center side in the crown portion 12 has a lower rigidity as compared with the outer edge portion 12*e*. Accordingly, the antinode of the vibration is located on the crown center side of the crown atypically-shaped portion. The presence of the crown rib on the crown center side of the crown atypically-shaped portion can effectively suppress the occurrence of the low-frequency vibration, whereby an excessively low-pitched sound at impact can be improved.

The crown rib may intersect the crown atypically-shaped portion or may be located apart from the crown atypically-shaped portion. Since a portion located on the crown center side of the crown atypically-shaped portion easily vibrates, when the crown rib is located apart from the crown atypically-shaped portion toward the crown center side, the occurrence of the low-frequency vibration is effectively suppressed and the effect of improving sound at impact is enhanced.

The specific side is a side located on the crown center side having a low rigidity, and thus is likely to be the starting point of vibration. As shown in FIG. 29 and FIG. 30, a portion having a large amplitude of vibration is distributed substantially along the specific side of the crown atypically-shaped portion. When the crown rib is disposed substantially parallel to the specific side, the occurrence of the low-frequency vibration can be effectively suppressed, and sound at impact can be improved.

Although the amplitude of vibration is large on and near the contour line of the crown atypically-shaped portion, the vibration extends to the vicinity of the crown center RC. The amplitude of vibration becomes smaller with increasing proximity to the crown center RC. By changing the position of the crown rib in the area between the center C1 of the crown atypically-shaped portion and the crown center RC, the natural frequency can be effectively adjusted. As a result, the pitch of sound at impact can be adjusted by the position of the crown rib. For example, as in the head 130 (FIG. 22), when the crown rib 150 is disposed apart from the crown atypically-shaped portion 140 and is located closer to the crown center RC, an increase in the natural frequency can be suppressed. This can make it possible to obtain a lower-pitched sound at impact than when the crown rib is disposed at a position having the maximum amplitude of vibration, although the obtained sound at impact is higher-pitched than when there is no crown rib. The presence of the crown rib can enable to effectively adjust the sound at impact while an excessively low-pitched sound at impact can be improved.

By positioning at least one of the ends of the crown rib in the outer edge portion 12*e* having a high rigidity, the above-mentioned vibration suppression effect brought by the crown rib is enhanced, and the sound at impact can be effectively higher pitched. As in the head 190 (FIG. 24), when both ends of the crown rib 210 are not disposed in the outer edge portion 12*e*, the above-mentioned vibration suppression effect decreases. This configuration is effective when one desires to adjust sound at impact to be a little lower pitched.

When the face-side end of the crown rib is disposed in the outer edge portion 12*e*, this crown rib can suppress the deformation of the face portion 10, and can reduce the coefficient of restitution of the head. From this viewpoint, the face-side end of the crown rib is preferably positioned on the back side relative to the outer edge portion 12*f*.

As shown in FIG. 29, in the head 4*x*, a portion having the maximum amplitude in the primary vibration mode is located in the crown portion 12. This holds true for the head 4 having the crown rib 30. On the other hand, when the sole rib 40 is removed from the head 4 (FIG. 11), such a portion having the maximum amplitude in the primary vibration mode is located in the sole portion 14, and the vibration mode shown in FIG. 29 is the tertiary vibration mode. The sole portion 14 of the head 4 includes the sole rib 40 that shifts the portion having the maximum amplitude in the primary vibration mode from the sole portion 14 to the crown portion 12. Because of the presence of the sole rib 40, a region that has the maximum vibration in the primary vibration mode is positioned in the crown portion 12. Accordingly, the primary natural frequency can be changed by the crown rib 30. The primary natural frequency has a greater effect on the pitch of sound at impact felt by golfers, as compared with the secondary and subsequent natural frequencies. Accordingly, sound at impact can be effectively adjusted by the crown rib 30.

As shown in FIG. 30, in the head 50*x*, a portion having the maximum amplitude in the primary vibration mode is positioned in the crown portion 12. This holds true for the head 50 having the crown rib 70. On the other hand, when the sole rib 80 is removed from the head 50 (FIG. 16), such a portion having the maximum amplitude in the primary vibration mode is located in the sole portion 14, and the vibration mode shown in FIG. 27 is the secondary vibration mode. The sole portion 14 of the head 50 includes the sole rib 80 that shifts the portion having the maximum amplitude in the primary vibration mode from the sole portion 14 to the crown portion 12. Because of the presence of the sole rib 80, a region that has the maximum vibration in the primary vibration mode is positioned in the crown portion 12. Accordingly, the primary natural frequency can be changed by the crown rib 70. Accordingly, sound at impact can be effectively adjusted by the crown rib 70.

A double-pointed arrow E1 in FIG. 22 shows the length of the crown rib. The length E1 is measured in the planar view. The length E1 is the length (route length) of the rib center line in the planar view.

From the viewpoint of suppressing the occurrence of the low frequency vibration which can be caused by the crown atypically-shaped portion and obtaining a higher-pitched sound at impact, the length E1 of the crown rib is preferably greater than or equal to 50 mm, more preferably greater than or equal to 60 mm, and still more preferably greater than or equal to 70 mm. Dimensions of the crown portion 12 is limited due to the restriction on the head volume imposed by the rules of golf. From this viewpoint, the length E1 of the crown rib is preferably less than or equal to 110 mm, more preferably less than or equal to 105 mm, and still more preferably less than or equal to 100 mm.

When the contour line of the crown atypically-shaped portion has the specific side, the length of the specific side is not limited. When the specific side is long, the vibration of the crown portion 12 caused by the specific side increases. Accordingly, when the specific side is long, the effect of the crown rib is large. From this viewpoint, the length of the specific side is preferably greater than or equal to 15 mm, more preferably greater than or equal to 20 mm, and still more preferably greater than or equal to 25 mm. An excessively long specific side is likely to result in an excessively lower-pitched sound at impact. From this viewpoint, the length of the specific side is preferably less than or equal to 70 mm, more preferably less than or equal to 60 mm, still more preferably less than or equal to 50 mm, still more preferably less than or equal to 45 mm, and yet still more preferably less than or equal to 40 mm. The length of the specific side is measured in the planar view. The length of the specific side is the length (route length) in the plan view.

The crown atypically-shaped portion 20 of the first embodiment includes the side wall surface 24 (FIG. 3). As described above, the specific side CL24 is the starting line of the side wall surface 24. That is, the specific side CL24 is the lower edge of the side wall surface 24. In this case, the angle of the corner of the bent portion 28 of the crown atypically-shaped portion 20 becomes large, and the crown portion 12 easily vibrates. Accordingly, this configuration enhances the sound-at-impact improving effect and the sound-at-impact adjusting effect brought by the crown rib 30.

The position of the crown atypically-shaped portion in the crown portion 12 is not limited. In each of the above embodiments, the crown atypically-shaped portion is disposed on the heel side relative to the crown center RC. The crown atypically-shaped portion may be disposed on the toe side relative to the crown center RC, for example. The crown atypically-shaped portion may be disposed on the back side relative to the crown center RC, for example. The crown atypically-shaped portion is preferably disposed at a position apart from the crown center RC.

The base surface b1 of the crown outer surface 12*a* is a convex curved surface as a whole, but has a portion that is relatively flat in the vicinity of the hosel portion 16. A portion that is connected to the outer surface of the hosel portion 16 from the crown outer surface 12*a* is a concave curved surface. Accordingly, a transition portion in which the convex curved surface changes into the concave curved surface is formed on the crown outer surface 12*a*, and the transition portion is relatively flat. The transition portion is located at a position close to the hosel portion 16 and is positioned on the heel side in the crown portion 12. The transition portion has a lower rigidity than that of the convex curved surface. When the transition portion is located close to the crown atypically-shaped portion, portions that easily vibrate are adjacent to each other, which tends to cause a low frequency vibration. Accordingly, in this case, the advantageous effect of the presence of the crown rib is high. From this viewpoint, it is preferable that the entirety of the crown atypically-shaped portion is located on the heel side relative to the crown center RC. The entirety of the crown atypically-shaped portion is preferably located on the heel side relative to the face center Fc.

A double-pointed arrow D1 in FIG. 5 shows a distance between each point on the contour line CL20 and the contour line CL4 of the crown portion 12. The distance D1 is defined as a distance (shortest distance) in the transverse cross-sectional contour line. By reducing the minimum value of the distance D1, the crown atypically-shaped portion 20 is located closer to the outer edge portion 12*e*. In this case, the vibration of the crown portion 12 is effectively suppressed on the outer edge portion 12*e* side of the crown atypically-shaped portion 20. Accordingly, the sound-at-impact improving effect and the sound-at-impact adjusting effect can be obtained only by the crown rib 30 located on the crown center side of the crown atypically-shaped portion 20. From this viewpoint, the minimum value of the distance D1 is preferably less than or equal to 20 mm, more preferably less than or equal to 15 mm, and still more preferably less than or equal to 10 mm. The minimum value of the distance D1 may be 0 mm.

A double-pointed arrow D2 in FIG. 22 shows the shortest distance between the rib center line of the crown rib and the specific side. The antinode of vibration of the crown portion 12 caused by the crown atypically-shaped portion is positioned close to the specific side. From the viewpoint of obtaining a higher-pitched sound at impact, the distance D2 is preferably less than or equal to 20 mm, more preferably less than or equal to 15 mm, and still more preferably less than or equal to 10 mm. As described above, the distance D2 may be 0 mm. When a lower-pitched sound at impact is desired, the distance D2 can be increased. By changing the distance D2, the sound at impact can be effectively adjusted. The distance D2 is measured in the planar view.

From the viewpoint of enhancing the rigidity of the crown portion by the crown rib, the height Hr (FIG. 13B) of the crown rib is preferably greater than or equal to 2.5 mm, more preferably greater than or equal to 3 mm, and still more preferably greater than or equal to 3.5 mm. From the viewpoint of suppressing the weight of the crown rib, the height Hr of the crown rib is preferably less than or equal to 7.5 mm, more preferably less than or equal to 7 mm, and still more preferably less than or equal to 6.5 mm.

From the viewpoint of enhancing the advantageous effect brought by the sole rib, the height of the sole rib is preferably greater than or equal to 2.5 mm, more preferably greater than or equal to 3 mm, still more preferably greater than or equal to 3.5 mm, and yet more preferably greater than or equal to 4 mm. From the viewpoint of enhancing the advantageous effect brought by the sole rib, the sole rib may have a height higher than the height Hr of the crown rib. From the viewpoint of suppressing the weight of the sole rib, the height of the sole rib is preferably less than or equal to 10 mm, more preferably less than or equal to 9 mm, and still more preferably less than or equal to 8 mm. The height of the sole rib is measured in the same manner as the height Hr of the crown rib.

From the viewpoint of the degree of freedom in design of the head, the maximum height of the crown atypically-shaped portion may be greater than or equal to 1 mm, further may be greater than or equal to 2 mm, and still further may be greater than or equal to 3 mm. From the viewpoint of easy production, the maximum height of the crown atypically-shaped portion may be less than or equal to 10 mm, further may be less than or equal to 9 mm, and still further may be less than or equal to 8 mm. The maximum height of the crown atypically-shaped portion means the maximum value of the height Ht (see FIG. 9).

A double-pointed arrow W2 in FIG. 3 shows the longest traverse length of the contour line CL20 in the planar view. The longest traverse length W2 is the maximum value of the length of a line segment S3 that extends from a first end located at a first point on the contour line CL20 to a second end located at a second point on the contour line CL20. From the viewpoint of increasing the degree of freedom in design of the head, the longest traverse length W2 is preferably greater than or equal to 30 mm, more preferably greater than or equal to 35 mm, and still more preferably greater than or equal to 40 mm. From the viewpoint of sound at impact, the longest traverse length W2 is preferably less than or equal to 80 mm, more preferably less than or equal to 75 mm, and still more preferably less than or equal to 70 mm.

From the viewpoint of increasing the degree of freedom in design of the head, the total area of the crown atypically-shaped portion in the planar view is preferably greater than or equal to 250 $mm^2$, more preferably greater than or equal to 300 $mm^2$, and still more preferably greater than or equal to 350 $mm^2$. From the viewpoint of sound at impact, the total area of the crown atypically-shaped portion in the planar view is preferably less than or equal to 1400 $mm^2$, more preferably less than or equal to 1300 $mm^2$, and still more preferably less than or equal to 1200 $mm^2$. This total area is the area of a figure indicated by the contour line CL20. When a plurality of crown atypically-shaped portions are present, the total area is the sum total of the areas of the crown atypically-shaped portions.

A large head volume tends to cause a loud sound at impact. In addition, when dimensions of the crown portion 12 is larger, the crown atypically-shaped portion has a larger effect on the sound at impact. Accordingly, the crown rib of the present disclosure exhibits a higher advantageous effect when the head has a large volume. From this viewpoint, the head volume is preferably greater than or equal to 200 $cm^3$, more preferably greater than or equal 300 $cm^3$, more preferably greater than or equal 410 $cm^3$, more preferably greater than or equal 430 $cm^3$, and still more preferably greater than or equal 450 $cm^3$. From the viewpoint of the rules of golf, the head volume is preferably less than or equal to 470 $cm^3$, more preferably less than or equal to 465 $cm^3$, and still more preferably less than or equal to 460 $cm^3$.

Regarding the above-described embodiments, the following clauses are disclosed.

[Clause 1]

A hollow golf club head including:

a face portion that forms a striking face;

a crown portion that forms a crown outer surface and a crown inner surface;

a sole portion that forms a sole outer surface and a sole inner surface; and a hosel portion, wherein the crown portion includes a crown atypically-shaped portion and a crown rib that is disposed on the crown inner surface, the crown atypically-shaped portion is a crown projection that forms a projection on the crown outer surface while forming a recess on the crown inner surface, or a crown recess that forms a recess on the crown outer surface while forming a projection on the crown inner surface, and the crown rib is disposed on a crown center side relative to a center of the crown atypically-shaped portion.

[Clause 2]

The golf club head according to clause 1, wherein the crown rib is disposed on the crown center side relative to an entirety of the crown atypically-shaped portion.

[Clause 3]

The golf club head according to clause 1 or 2, wherein at least one of ends of the crown rib is positioned in an outer edge portion of the crown portion.

[Clause 4]

The golf club head according to any one of clauses 1 to 3, wherein an entirety of the crown atypically-shaped portion is disposed in a region that extends from a contour line of the crown portion to a position 40 mm apart from the contour line.

[Clause 5]

The golf club head according to any one of clauses 1 to 4, wherein a contour line of the crown atypically-shaped portion has at least one side, and the at least one side includes a specific side that is positioned on the crown center side relative to the center of the crown atypically-shaped portion.

[Clause 6]

The golf club head according to clause 5, wherein the crown rib extends substantially parallel to the specific side.

[Clause 7]

The golf club head according to any one of clauses 1 to 6, wherein the sole portion includes a sole rib that shifts a portion having a maximum amplitude in a primary vibration mode of the golf club head from the sole portion to the crown portion.

LIST OF REFERENCE NUMERALS

2 Golf club

4, 50, 90, 130, 160, 190, 220, 4*y*, 4*z* Head

6 Shaft
10 Face portion
10*a* Striking face
12 Crown portion
12*a* Crown outer surface
12*b* Crown inner surface
14 Sole portion
14*a* Sole outer surface
14*b* Sole inner surface
16 Hosel portion
20, 60, 100, 140, 170, 200, 230, 240 Crown atypically-shaped portion
26, 62, 142, 172, 202, 232, 242 Crown projection
102 Crown recess
30, 70, 110, 150, 180, 210, 250 Crown rib
40, 80, 120 Sole rib
CL24, CL65, CL104, CL144, CL171, CL201, CL231, CL241 Specific side
CL2 Outer contour line of a head in the planar view
CL4 Contour line of a crown portion in the planar view
RC Crown center
C1 Center of a crown atypically-shaped portion
Z Shaft axis line The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A hollow golf club head comprising:
a face portion that forms a striking face;
a crown portion that forms a crown outer surface and a crown inner surface;
a sole portion that forms a sole outer surface and a sole inner surface; and
a hosel portion, wherein
the crown portion includes a crown atypically-shaped portion and a crown rib that is disposed on the crown inner surface,
the crown atypically-shaped portion is a hollow crown projection that forms a projection on the crown outer surface while forming a recess on the crown inner surface,
in a planar view of the golf club head, the crown rib is disposed on a crown center side relative to a center of the crown atypically-shaped portion,
the crown center side refers to a position closer to a crown center,
the center of the crown atypically-shaped portion refers to a geometric center of a closed figure indicated by a contour line of the crown atypically-shaped portion that defines an overall shape of the crown atypically-shaped portion in the planar view,
the crown center refers to a point obtained by moving a geometric center of a closed figure, indicated by an outer contour line of the golf club head that defines an overall shape of the golf club head toward a back side by half of a distance Da in the planar view,
when a frontmost point of the golf club head in a longitudinal cross section that passes through the geometric center of the golf club head is denoted by T1, and an uppermost point of the striking face in the longitudinal cross section is denoted by T2, then the distance Da is a distance between the frontmost point T1 and the uppermost point T2 in the planar view,
in the planar view, the crown rib is disposed between the closed figure indicated by the contour line of the crown atypically-shaped portion and the crown center,
on the crown outer surface, the hollow crown projection protrudes from a crown base surface that forms a convex curved surface, the contour line of the crown atypically-shaped portion is a boundary line between the crown base surface and the crown atypically-shaped portion, and
in a cross section of the crown outer surface, the contour line of the crown atypically-shaped portion is indicated by an inflection point or a vertex of an angular corner.

2. The golf club head according to claim 1, wherein at least one of ends of the crown rib is positioned in an outer edge portion of the crown portion.

3. The golf club head according to claim 1, wherein, in the planar view, all points on the contour line of the crown atypically-shaped portion each have a shortest distance from a contour line of the crown portion of less than or equal to 40 mm.

4. The golf club head according to claim 1, wherein
the contour line of the crown atypically-shaped portion has at least one side, and
the at least one side includes a specific side that intersects a line segment extending from the center of the crown atypically-shaped portion to the crown center in the planar view.

5. The golf club head according to claim 4, wherein the crown rib extends substantially parallel to the specific side.

6. The golf club head according to claim 1, wherein the sole portion includes a sole rib that shifts a maximum amplitude in a primary vibration mode of the golf club head from the sole portion to the crown portion.

7. The golf club head according to claim 1, wherein a maximum amplitude in a primary vibration mode of the golf club head is located in the crown portion.

8. The golf club head according to claim 1, wherein the crown atypically-shaped portion does not include a rib.

9. The golf club head according to claim 1, wherein in a plan view of the golf club head, a virtual line that represents a line segment that extends from the center of the crown atypically-shaped portion to the crown center intersects a virtual line representing the crown rib.

10. The golf club head according to claim 1, wherein an entirety of the crown atypically-shaped portion is located on a heel side relative to a face center.

11. A hollow golf club head comprising:
a face portion that forms a striking face;
a crown portion that forms a crown outer surface and a crown inner surface;
a sole portion that forms a sole outer surface and a sole inner surface; and
a hosel portion, wherein the crown portion includes a crown atypically-shaped portion and a crown rib that is disposed on the crown inner surface, the crown atypically-shaped portion is a hollow crown projection that forms a projection on the crown outer surface while forming a recess on the crown inner surface, in a planar view of the golf club head, the crown rib is disposed on a crown center side relative to a center of the crown atypically-shaped portion, the crown center side refers to a position closer to a crown center, the center of the crown atypically-shaped portion refers to a geometric center of a closed figure indicated by a contour line of the crown atypically-shaped portion that defines an overall shape of the crown atypically-shaped portion in the planar view, the crown center refers to a point obtained by moving a geometric center of a closed figure, indicated by an outer contour line of the golf club head that defines an overall shape of the golf club head toward a back side by half of a distance Da in the planar view, when a frontmost point of the golf club head in a longitudinal cross section that passes through the geometric center of the golf club head is denoted by T1, and an uppermost point of the striking face in the longitudinal cross section is denoted by T2, then the distance Da is a distance between the frontmost point T1 and the uppermost point T2 in the planar view, the sole portion includes a sole rib that is disposed on the sole inner surface, in the planar view, the crown rib is disposed between the closed figure indicated by the contour line of the crown atypically-shaped portion and the crown center, on the crown outer surface, the hollow crown projection protrudes from a crown base surface that forms a convex curved surface, the contour line of the crown atypically-shaped portion is a boundary line between the crown base surface and the crown atypically-shaped portion, and in a cross section of the crown outer surface, the contour line of the crown atypically-shaped portion is indicated by an inflection point or a vertex of an angular corner.

12. The golf club head according to claim 11, wherein at least one of ends of the crown rib is positioned in an outer edge portion of the crown portion.

13. The golf club head according to claim 11, wherein, in the planar view, all points on the contour line of the crown atypically-shaped portion each have a shortest distance from a contour line of the crown portion of less than or equal to 40 mm.

14. The golf club head according to claim 11, wherein the contour line of the crown atypically-shaped portion has at least one side, and the at least one side includes a specific side that intersects a line segment extending from the center of the crown atypically-shaped portion to the crown center in the planar view.

15. The golf club head according to claim 14, wherein the crown rib extends substantially parallel to the specific side.

16. The golf club head according to claim 11, wherein the sole rib shifts a maximum amplitude in a primary vibration mode of the golf club head from the sole portion to the crown portion.

17. The golf club head according to claim 11, wherein the sole rib has a height greater than a height of the crown rib, the height of the crown rib is measured in a direction perpendicular to a line segment that extends from a first starting point to a second starting point of the crown rib in a cross section taken along a width direction of the crown rib, and the height of the sole rib is measured in a direction perpendicular to a line segment that extends from a first starting point to a second starting point of the sole rib in a cross section taken along a width direction of the sole rib.

18. The golf club head according to claim 11, wherein a virtual line showing the sole rib intersects a virtual line showing the crown rib in a plan view of the golf club head.

19. The golf club head according to claim 11, wherein a maximum amplitude in a primary vibration mode of the golf club head is located in the crown portion.

20. A hollow golf club head comprising:

a face portion that forms a striking face;

a crown portion that forms a crown outer surface and a crown inner surface;

a sole portion that forms a sole outer surface and a sole inner surface; and a hosel portion, wherein the crown portion includes a crown atypically-shaped portion and a crown rib that is disposed on the crown inner surface, the crown atypically-shaped portion is a crown projection that forms a projection on the crown outer surface while forming a recess on the crown inner surface, in a planar view of the golf club head, the crown rib is disposed such that a virtual line representing the crown rib intersects all virtual line segments that connect a crown center and all points located on a contour line of the crown atypically-shaped portion, that defines an overall shape of the crown atypically-shaped portion in the planar view the crown center refers to a point obtained by moving a geometric center of a closed figure, indicated by an outer contour line of the golf club head that defines an overall shape of the golf club head toward a back side by half of a distance Da in the planar view, when a frontmost point of the golf club head in a longitudinal cross section that passes through the geometric center of the golf club head is denoted by T1, and an uppermost point of the striking face in the longitudinal cross section is denoted by T2, then the distance Da is a distance between the frontmost point T1 and the uppermost point T2 in the planar view, on the crown outer surface, the hollow crown projection protrudes from a crown base surface that forms a convex curved surface, the contour line of the crown atypically-shaped portion is a boundary line between the crown base surface and the crown atypically-shaped portion, and in a cross section of the crown outer surface, the contour line of the crown atypically-shaped portion is indicated by an inflection point or a vertex of an angular corner.

* * * * *